US012221732B2

(12) United States Patent
Tanaka et al.

(10) Patent No.: US 12,221,732 B2
(45) Date of Patent: Feb. 11, 2025

(54) LIQUID APPLICATION UNIT FOR LINEAR MEDIUM, LIQUID APPLICATION APPARATUS, DYEING EMBROIDERY SYSTEM, CONTROL METHOD, AND STORAGE MEDIUM

(71) Applicants: Shinya Tanaka, Kanagawa (JP); Yusuke Komine, Kanagawa (JP); Taito Omura, Kanagawa (JP); Yuuki Gotoh, Kanagawa (JP)

(72) Inventors: Shinya Tanaka, Kanagawa (JP); Yusuke Komine, Kanagawa (JP); Taito Omura, Kanagawa (JP); Yuuki Gotoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 662 days.

(21) Appl. No.: 17/488,313

(22) Filed: Sep. 29, 2021

(65) Prior Publication Data

US 2022/0098778 A1 Mar. 31, 2022

(30) Foreign Application Priority Data

Sep. 30, 2020 (JP) ..... 2020-166554
Jul. 30, 2021 (JP) ..... 2021-126096

(51) Int. Cl.

| | |
|---|---|
| ***D05C 11/24*** | (2006.01) |
| ***D06B 1/02*** | (2006.01) |
| ***D06B 23/00*** | (2006.01) |
| ***D06P 1/00*** | (2006.01) |

(52) U.S. Cl.
CPC ..... *D06B 1/02* (2013.01); *D05C 11/24* (2013.01); *D06B 23/00* (2013.01); *D06P 1/0004* (2013.01)

(58) Field of Classification Search
CPC ..... D05C 11/24; D06B 23/00
See application file for complete search history.

(56) References Cited

U.S. PATENT DOCUMENTS

| | | | |
|---|---|---|---|
| 2019/0299692 | A1 | 10/2019 | Toda et al. |
| 2020/0171846 | A1 | 6/2020 | Hayashi et al. |
| 2020/0171854 | A1 | 6/2020 | Sunaoshi et al. |
| 2020/0207117 | A1 | 7/2020 | Ikegami |

(Continued)

FOREIGN PATENT DOCUMENTS

| | | | | |
|---|---|---|---|---|
| EP | 3984757 | A1 * | 4/2022 | ..... B41J 3/4078 |
| EP | 4201680 | A1 * | 6/2023 | ..... B41J 2/16508 |

(Continued)

*Primary Examiner* — Tajash D Patel
(74) *Attorney, Agent, or Firm* — XSENSUS LLP

(57) ABSTRACT

A liquid application unit includes a supply member, a liquid application device, and an application controller. The supply member includes a cylindrical or columnar winding core around which a linear medium is wound. The liquid application device applies liquid to the linear medium unwound and fed from the supply member. The application controller adjusts a liquid application length of the liquid applied by the liquid application unit to the linear medium in a feed direction of the linear medium. The application controller adjusts the liquid application length in the feed direction of the linear medium in accordance with a winding thickness of a remaining amount of the linear medium from an outer peripheral surface of the winding core.

11 Claims, 20 Drawing Sheets

(56) References Cited

U.S. PATENT DOCUMENTS

| | | | | |
|---|---|---|---|---|
| 2020/0276839 | A1 | 9/2020 | Satoh et al. | |
| 2021/0023837 | A1 | 1/2021 | Nagasu et al. | |
| 2022/0106720 | A1 * | 4/2022 | Gotoh | D05B 67/00 |

FOREIGN PATENT DOCUMENTS

| | | | | |
|---|---|---|---|---|
| JP | 2001-170380 | | 6/2001 | |
| JP | 2007-301733 | | 11/2007 | |
| JP | 2008-289522 | | 12/2008 | |
| JP | 2018-526540 | | 9/2018 | |
| WO | WO2016/204686 | A1 | 12/2016 | |
| WO | WO-2023275562 | A1 * | 1/2023 | D06B 1/02 |
| WO | WO-2023275563 | A1 * | 1/2023 | D06B 1/02 |

* cited by examiner

ELONGATION ON DOWNSTREAM SIDE

ELONGATION ON DOWNSTREAM SIDE

LENGTH AT DYEING: X
ELONGATION OF THREAD HAVING WEAK WINDING CURL: Y1
ELONGATION OF THREAD HAVING WEAK WINDING CURL: Y2
Y1 < Y2

| WINDING THICKNESS (mm) | CORRECTION VALUE OF HEAD 30K | CORRECTION VALUE OF HEAD 30C | CORRECTION VALUE OF HEAD 30M | CORRECTION VALUE OF HEAD 30Y |
|---|---|---|---|---|
| 100 | 1 | 1 | 1 | 1 |
| 60 | 0.95 | 0.96 | 0.97 | 0.98 |
| 30 | 0.9 | 0.92 | 0.94 | 0.96 |
| 20 | 0.85 | 0.88 | 0.91 | 0.94 |
| 10 | 0.8 | 0.84 | 0.88 | 0.92 |
| 5 | 0.75 | 0.8 | 0.85 | 0.9 |

LIQUID APPLICATION UNIT FOR LINEAR MEDIUM, LIQUID APPLICATION APPARATUS, DYEING EMBROIDERY SYSTEM, CONTROL METHOD, AND STORAGE MEDIUM

CROSS-REFERENCE TO RELATED APPLICATIONS

This patent application is based on and claims priority pursuant to 35 U.S.C. § 119(a) to Japanese Patent Application Nos. 2020-166554, filed on Sep. 30, 2020, and 2021-126096, filed on Jul. 30, 2021, in the Japan Patent Office, the entire disclosure of each of which is incorporated by reference herein.

BACKGROUND

Technical Field

Embodiments of the present disclosure relate to a liquid application unit for a linear medium, a liquid application apparatus, a dyeing embroidery system, a control method, and a storage medium.

Related Art

In recent years, there has been known a technique of an in-line type dyeing embroidery apparatus that dyes (colors) a thread in a preceding stage of an embroidery unit.

A technology of controlling an embroidery apparatus, for example, performs embroidery using a continuous upper thread whose color changes such that a color change point of the upper thread is not exposed on the surface of the embroidery. In the technology, embroidery data is created for performing embroidery such that the color change point of the upper thread whose color changes is not visible from the upper side.

However, as a property of the thread, when the thread for dyeing is drawn out from a supplier such as a bobbin, a winding curl and the rotation speed of the thread vary depending on the outer diameter (outer winding diameter) of the remaining amount of the thread on the bobbin. If the strength of the winding curl of the thread is different, the amount of elongation of the thread toward the downstream side changes when the winding curl is released.

SUMMARY

According to an embodiment of the present disclosure, there is provided a liquid application unit that includes a supply member, a liquid application device, and an application controller. The supply member includes a cylindrical or columnar winding core around which a linear medium is wound. The liquid application device applies liquid to the linear medium unwound and fed from the supply member. The application controller adjusts a liquid application length of the liquid applied by the liquid application unit to the linear medium in a feed direction of the linear medium. The application controller adjusts the liquid application length in the feed direction of the linear medium in accordance with a winding thickness of a remaining amount of the linear medium from an outer peripheral surface of the winding core.

According to another embodiment of the present disclosure, there is provided a control method for a liquid application apparatus that includes: a supply member including a cylindrical or columnar winding core around which a linear medium is wound; and a liquid application device to apply liquid to the linear medium unwound and fed from the supply member. The control method includes: detecting or calculating a winding thickness of a remaining amount of the linear medium from an outer peripheral surface of the winding core; adjusting a liquid application length of the liquid applied by the liquid application device to the linear medium in a feed direction of the linear medium in accordance with the winding thickness of the remaining amount of the linear medium; and applying, by the liquid application device, the liquid to the linear medium being ted at the liquid application length adjusted in the feed direction.

According to still another embodiment of the present disclosure, there is provided a non-transitory computer-readable storage medium storing program code for causing an information processing apparatus to execute control of a liquid application apparatus that includes: a supply member including a cylindrical or columnar winding core around which a linear medium is wound; and a liquid application device configured to apply liquid to the linear medium unwound and fed from the supply member. The control includes: detecting or calculating a winding thickness of a remaining amount of the linear medium from an outer peripheral surface of the winding core; adjusting a liquid application length of the liquid applied by the liquid application device to the linear medium in a feed direction of the linear medium in accordance with the winding thickness of the remaining amount of the linear medium; and applying, by the liquid application device, the liquid to the linear medium being fed at the liquid application length adjusted in the feed direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
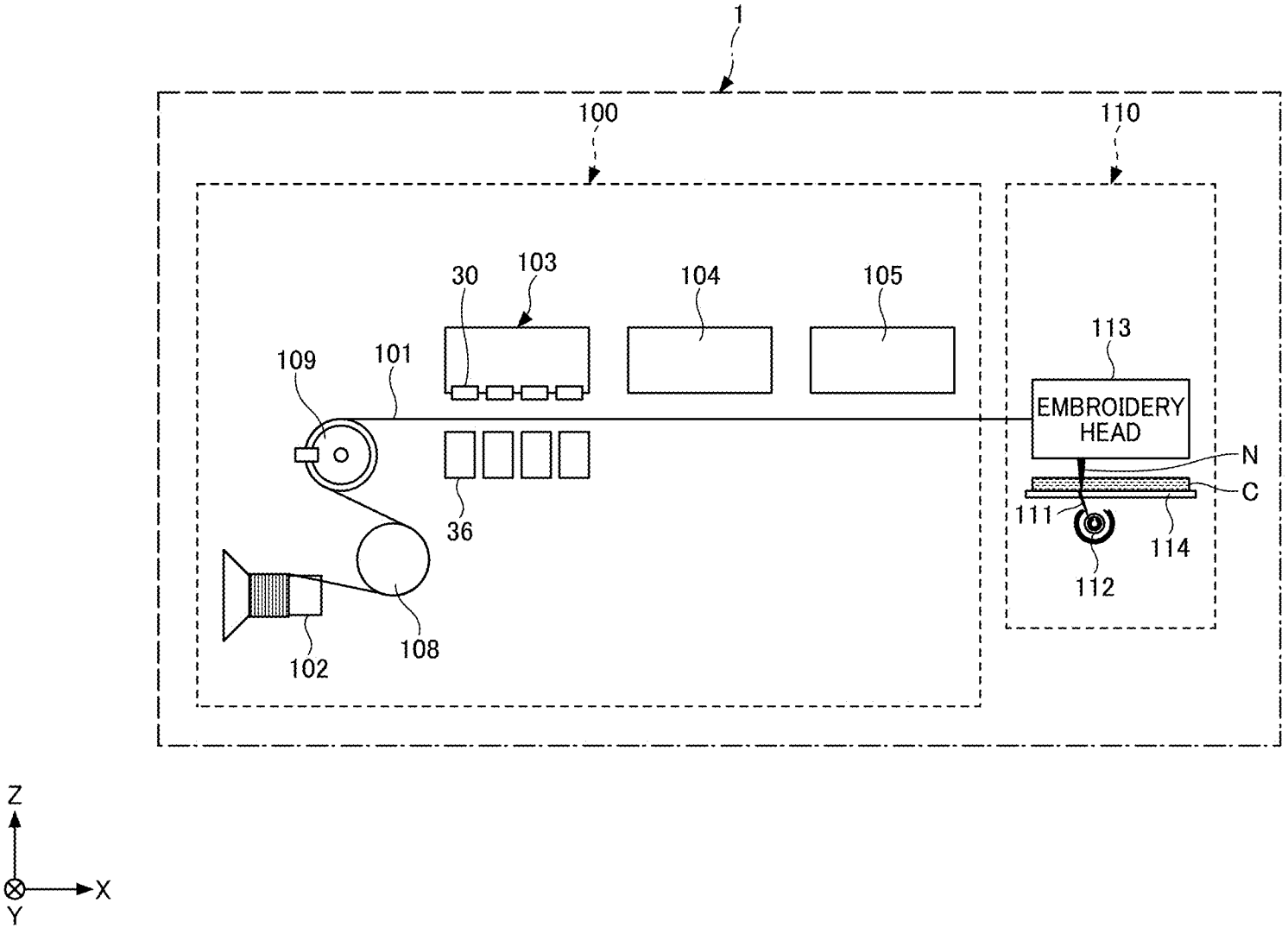
FIG. 1 is a schematic view of a dyeing embroidery apparatus including a liquid application unit according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure are described with reference to the drawings. In the following drawings, the same components are denoted by the same reference numerals, and redundant description may be omitted.

Overall Structure

Figure 2:
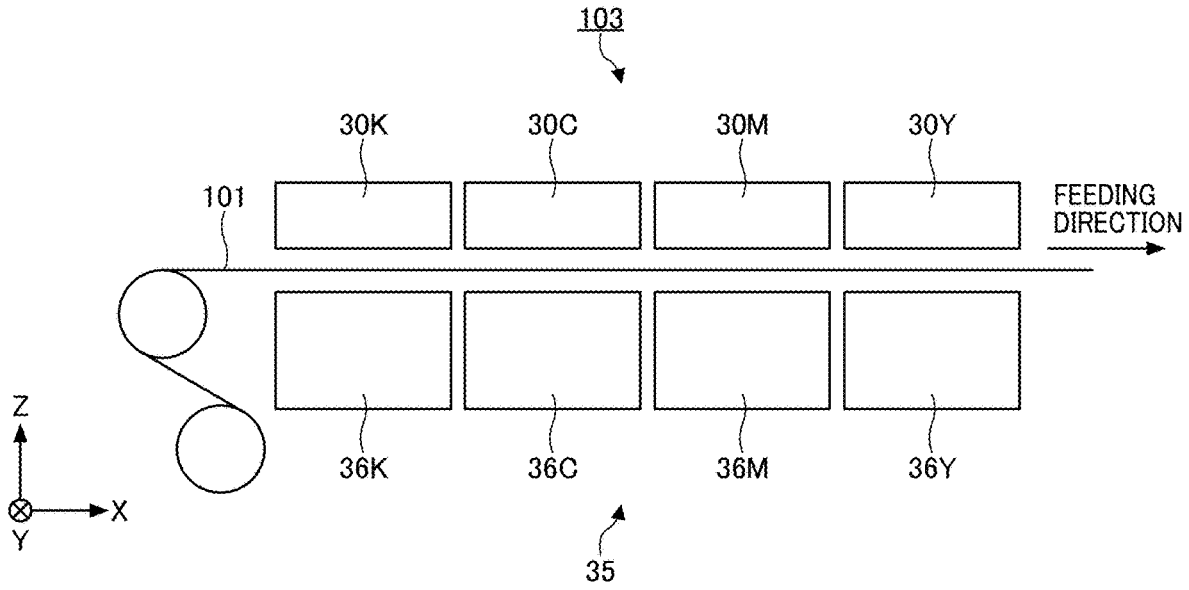
FIG. 2 is a schematic side view of a liquid application device in the liquid application unit according to the first embodiment of the present disclosure.
Figure 3:
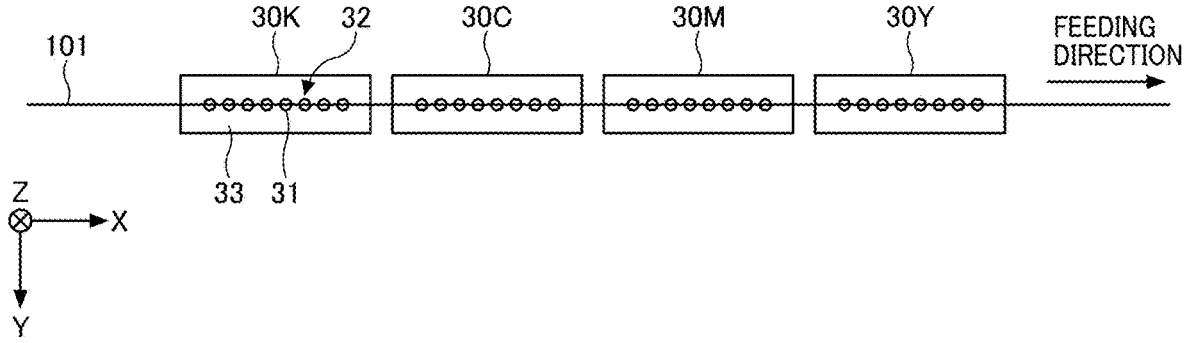
FIG. 3 is a schematic bottom view of the liquid application device according to the first embodiment of the present disclosure.

First, a dyeing embroidery apparatus including a liquid application unit according to a first embodiment of the present disclosure is described with reference to FIGS. 1 to 3. FIG. 1 is a schematic view of a dyeing embroidery apparatus according to a first embodiment of the present disclosure. FIG. 2 is a schematic side view of a liquid application device of the liquid application unit according to the first embodiment. FIG. 3 is a schematic bottom view of the liquid application device according to the first embodiment.

Referring to FIG. 1, a dyeing embroidery apparatus 1 according to the present embodiment is an in-line type dyeing embroidery apparatus and includes a liquid application unit 100 and an embroidery unit 110.

The liquid application unit 100 serving as a dyeing unit includes a supply member 102 around which an upper thread 101 is wound, a liquid application device 103, a fixing device 104, and a post-processing device 105. The liquid application unit 100 according to the present embodiment is a dyeing unit that dyes a thread by a liquid discharge method.

The embroidery unit 110 includes a lower thread bobbin 112 around which a lower thread 111 is wound, an embroidery head 113 to which the upper thread 101 is fed, and an embroidery table 114. In the embroidery unit 110, the embroidery head 113 controls the movement (hand movement) of a needle N through which the upper thread 101 passes, to perform embroidery on a cloth C using the lower thread 111 fed in response to the feed of the upper thread 101.

In the liquid application unit 100, a thread 101 drawn out from the supply member (also referred to as an upper thread spool or supplier) 102 is guided by a roller 108 and a roller 109 and continuously routed to the embroidery head 113.

The liquid application device 103 includes a maintenance unit 35 including a plurality of liquid discharge heads 30K, 30C, 30M, and 30Y and a plurality of individual maintenance units 36K, 36C, 36M, and 36Y. The plurality of liquid discharge heads 30K, 30C, 30M, and 30Y (also collectively referred to as liquid discharge heads 30) discharge and apply liquids (dyeing liquids) of different colors to the thread 101 drawn out from the supply member 102 and fed. The plurality of individual maintenance units 36K, 36C, 36M, and 36Y (also collectively referred to as individual maintenance units 36) perform maintenance of the liquid discharge heads 30K, 30C, 30M, and 30Y.

Hereinafter, the direction in which the thread is fed from the liquid application device 103 to the embroidery unit 110 is referred to as X, the depth direction of the dyeing embroidery apparatus 1 (or the width direction of the thread is referred to as Y, and the height direction (vertical direction) is referred to as Z.

With reference to FIG. 2, the plurality of liquid discharge heads 30K, 30C, 30M, and 30Y are liquid applicators and are discharge heads that discharge different colors. For example, the liquid discharge head 30K discharges droplets (ink) of black (K), the liquid discharge head 30C discharges droplets of cyan (C), the liquid discharge head 30M discharges droplets of magenta (M), and the liquid discharge head 30Y discharges droplets of yellow (Y). The above-described order of colors is an example. In some embodiments, the colors may be arranged in an order different from the above-described order.

The maintenance units 36K, 36C, 36M, and 36Y respectively, are disposed below the liquid discharge heads 30K, 30C, 30M, and 30Y of the respective colors. As a maintenance recovery operation, the maintenance units 36K, 36C, 36M, and 36Y for example, cap the liquid discharge heads 30K, 30C, 30M, and 30Y when the liquid discharge heads 30K, 30C, 30M, and 30Y are not in use, receive dummy discharge of liquid droplets from the liquid discharge heads 30K, 30C, 30M, and 30Y, perform suction circulating operation of the nozzles in a state in which a dummy discharge receptacle is close to the heads, and perform a wiping operation of the nozzles.

Here, as illustrated in FIG. 3, each liquid discharge head 30 has a nozzle surface 33 on which a nozzle row 32 in which a plurality of nozzles 31 for discharging liquid droplets are arranged is formed. In each liquid discharge head 30, the nozzles 31 in the nozzle row 32 are arranged in the feed direction of the thread 101.

In FIG. 3, only one nozzle row 32 is illustrated on the nozzle surface 33. However, a plurality of nozzle rows 32 may be arranged on the nozzle surface 33. As the liquid discharge head 30 is moved in a direction orthogonal to the thread feed direction, the capping of the nozzle surface 33 and the coloring operations with different nozzle rows 32 can be performed.

With reference to FIG. 1, the fixing device 104 performs a fixing process (drying process) on the thread 101 to which the liquid discharged from the liquid application device 103 is applied. The fixing device 104 includes, for example, a heater such as an infrared irradiation device and a hot air sprayer, and heats the thread 101 to dry.

The post-processing device 105 includes, for example, a cleaner that cleans the thread 101, a tension adjuster that adjusts the tension of the thread 101, a feed amount detector that detects the amount of movement of the thread 101, and a lubricant applicator that lubricates the surface of the thread 101.

A liquid application unit 100 serving as a dyeing unit according to an embodiment of the present embodiment includes at least the liquid application device 103 that applies colored liquid to the thread 101. The fixing device 104 and the post-processing device 105 may not be included.

In the embroidery unit 110, the embroidery head 113 is an embroidery device that embroiders a pattern on a cloth C using the upper thread 101 and the lower thread 111.

In the present embodiment, the dyeing embroidery apparatus is described as an example of the liquid application apparatus. However, a liquid application apparatus according to an embodiment of the present disclosure is not limited to the dyeing embroidery apparatus and may be, for example, an apparatus using a linear medium such as a thread, for example, an apparatus such as a loom or a sewing machine.

Also note that the term "thread" includes glass fiber thread; wool thread; cotton thread; synthetic fiber thread; metallic thread; mixed thread of wool, cotton, polymer, or metal; and linear object (linear member or continuous material) to which yarn, filament, or liquid is applied. The term "thread" also includes braided cord and flatly braided cord.

Examples of the linear medium that can be dyed with liquid according to an embodiment of the present disclosure include, in addition to the above-described linear member, a belt-shaped member (continuous base material) to which liquid can be applied, such as a rope, a cable, or a cord. Any linear medium is a medium that has a narrow width and is continuous in the feed direction.

Figure 4A:
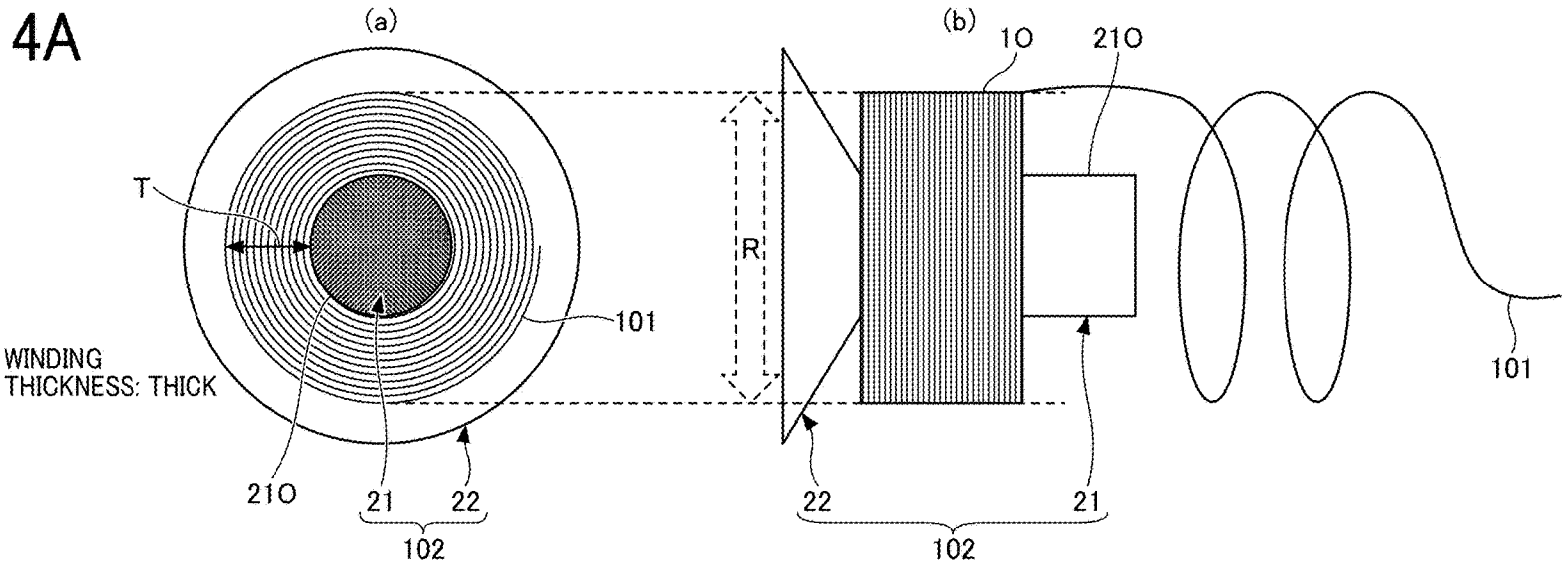
FIGS. 4A and 4B are diagrams illustrating the relationship between the winding thickness of the remaining amount of a thread in a supplier according to an embodiment of the present disclosure and the strength of the winding curl of the thread.
Figure 4B:
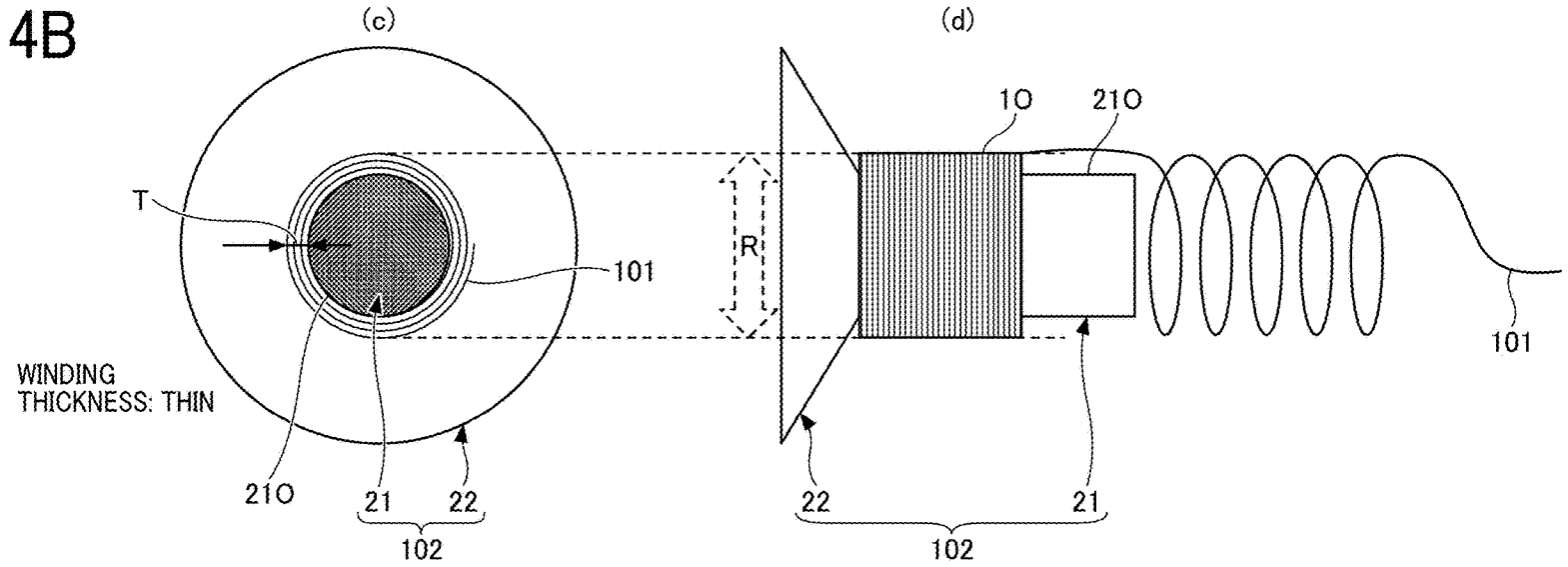

Winding thickness of remaining amount of thread of supplier and winding curl of thread and elongation of thread Here, with reference to FIGS. 4A and 4B and FIGS. 5A, 5B, 5C, and 5D, a description is given of the relationship among the winding thickness of the remaining amount of the thread in the supplier, the winding curl of the thread, and the elongation of the thread. FIGS. 4A and 4B are diagrams illustrating the relationship between the winding thickness of the remaining amount of the thread in the supplier and the winding curl of the thread. FIGS. 5A, 5B, 5C, and 5D are diagrams illustrating the relationship between the dyeing position on the thread and the amount of elongation of the thread on the downstream side.

Parts (a) and (b) of FIG. 4A illustrate a case where the remaining amount of the thread is large. Parts (c) and (d) of FIG. 4B illustrate a case where the remaining amount of the thread is small. Part (a) of FIG. 4A is a schematic view of the supplier seen from a free end side (+X side) of the supplier when the remaining amount of the thread is large. Part (b) FIG. 4A is a diagram illustrating a side surface of the supplier and the winding curl of the thread when the remaining amount of the thread is large. Part (c) of FIG. 4B is a schematic view of the supplier seen from the free end side (+X side) of the supplier when the remaining amount of the thread is small. Part (d) FIG. 4B is a diagram illustrating a side surface of the supplier and the winding curl of the thread when the remaining amount of the thread is small.

As illustrated in parts (a) and (b) of FIG. 4A and pars (c) and (d) of FIG. 4B, the supply member 102 serving as a supplier is a single-end type thread winding bobbin. The supply member 102 includes a columnar or cylindrical winding core (shaft core or core) 21 and a tapered flange portion 22 that limits a range in which the thread 101 is wound around one end of the winding core 21. The other end of the winding core 21 is a free end.

As illustrated in part (a) of FIG. 4A, when the remaining amount of the thread is large, the winding thickness T, which is the remaining amount of the thread, on the outer peripheral core surface 21O, which is the outer peripheral surface of the winding core 21, is large, the outermost peripheral remaining-thread surface 1O including the outermost thread on the winding core 21 is located outside away from the outer peripheral core surface 21O, and the winding outer diameter R, which is the outer radius of the outermost peripheral remaining-thread surface 1O, is large. On the other hand, as illustrated in part (c) of FIG. 4B, when the remaining amount of the thread is small, the winding thickness T of the remaining amount of the thread on the outer peripheral core surface 21O of the winding core 21 is small, the outermost peripheral remaining-thread surface 1O is located near the outer peripheral core surface 21O, and the winding outer diameter R of the outermost peripheral remaining-thread surface 1O is small.

Accordingly, in a state where the thread is wound around the winding core 21 before use, the thread located at a position where the winding outer diameter R is smaller is more strongly curled or twisted to maintain the shape.

Thus, when the remaining amount of the thread is large, as illustrated in part (b) of FIG. 4A, the winding curl of the thread is weak when the thread is drawn out from the supply member 102. In the case where the remaining amount of the thread is small, as illustrated in part (d) of FIG. 4B, the winding curl of the thread is strong when the thread is pulled out from the supply member 102.

As described above, when the thread is supplied from the supply member 102 which is a bobbin, the strength of the winding curl of the supplied thread changes depending on the winding outer diameter R that is the outer diameter of the outermost thread. The larger the winding outer diameter R, that is, the thicker the winding thickness T of the remaining thread amount, the weaker the winding curl of the thread. On the other hand, the smaller the winding outer diameter R and the smaller the winding thickness T of the remaining amount of the thread, the stronger the winding curl of the thread. When the strength of the winding curl of the thread changes, the amount of elongation when the thread is pulled after being unwound also changes.

Figure 5A:
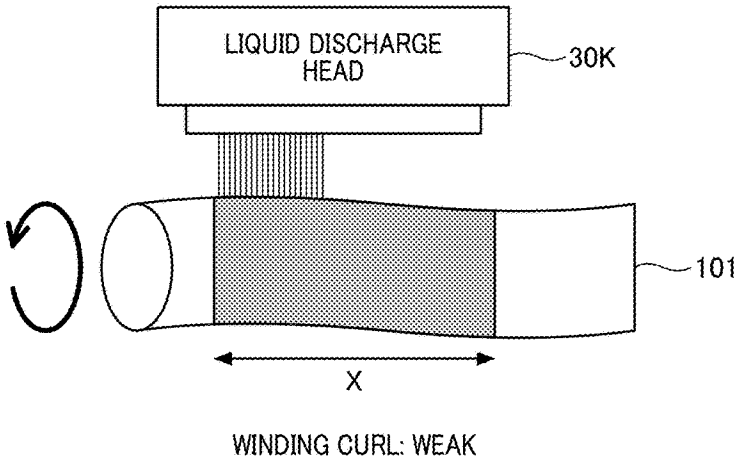
FIGS. 5A, 5B, 5C, and 5D are diagrams illustrating the relationship between the dyeing position on a thread and the amount of elongation of the thread on the downstream side.
Figure 5B:
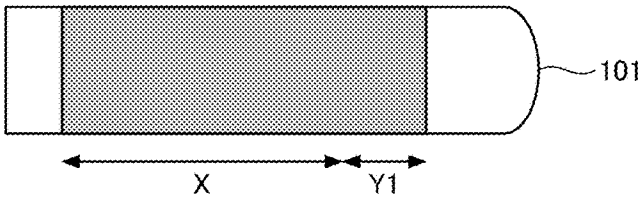
Figure 5C:
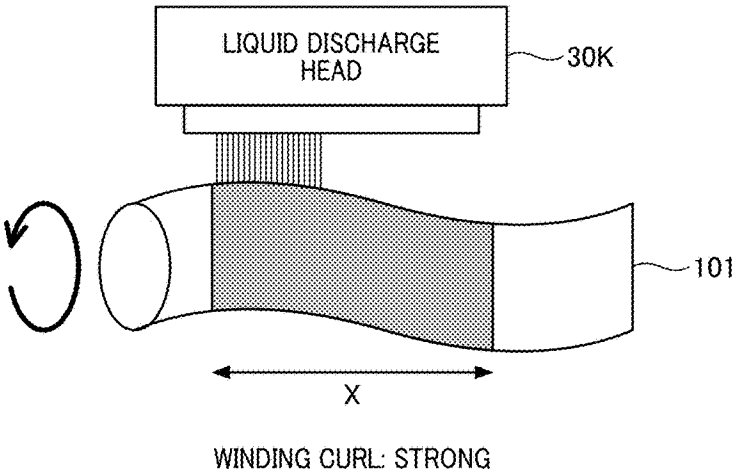
Figure 5D:
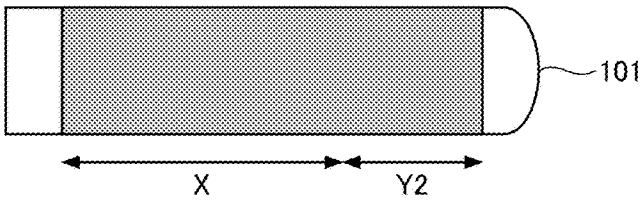

FIGS. 5A, 5B, 5C, and 5D are diagrams illustrating the relationship between the dyeing position on the thread and the amount of elongation of the thread on the downstream side. FIGS. 5A and 5B illustrate a case where the winding curl of the thread is weak. FIGS. 5C and 5D illustrate a case where the winding curl of the thread is strong. FIGS. 5A and 5C are diagrams illustrating the dyeing length on the thread at the time of dyeing. FIGS. 5B and 5D are diagrams illustrating the dyeing length on the thread on the downstream side.

When the strength of the winding curl of the thread changes due to the decrease in the winding outer diameter R of the thread before dyeing in the supply member 102 due to the consumption of the thread, the amount of elongation when the thread is pulled after being unwound also changes. In the process in which the thread is fed and supplied to the embroidery unit 110 via the liquid application device 103 serving as a dyeing section, the behavior of the thread changes due to the difference in the strength of the winding curl of the thread. When the winding curl is weak, the elongation amount of the thread on the downstream side is small. On the other hand, when the winding curl is strong, the thread is elongated downstream.

To be more specific, as illustrated in FIGS. 5A and 5C, even if dyeing is carried out with the same length X at the time of dyeing, the elongation Y1 of the thread is small on the downstream side as illustrated in FIG. 5B when the winding curl is weak. When the winding curl is strong, the elongation Y2 of the thread is large on the downstream side as illustrated in FIG. 5D.

Therefore, in the present embodiment, in consideration of the difference in the characteristics of the winding curl of the thread in the supplier, the dyeing length of the thread at the time of dyeing is changed in accordance with the winding outer diameter R of the thread before the thread is supplied in the supply member 102, that is, in accordance with the winding thickness T of the remaining thread amount. Such a configuration prevents the positional deviation of color in the embroidery unit 110 in the subsequent stage.

First Example of Correction of Dyeing Length

Figures 6A, 6B:
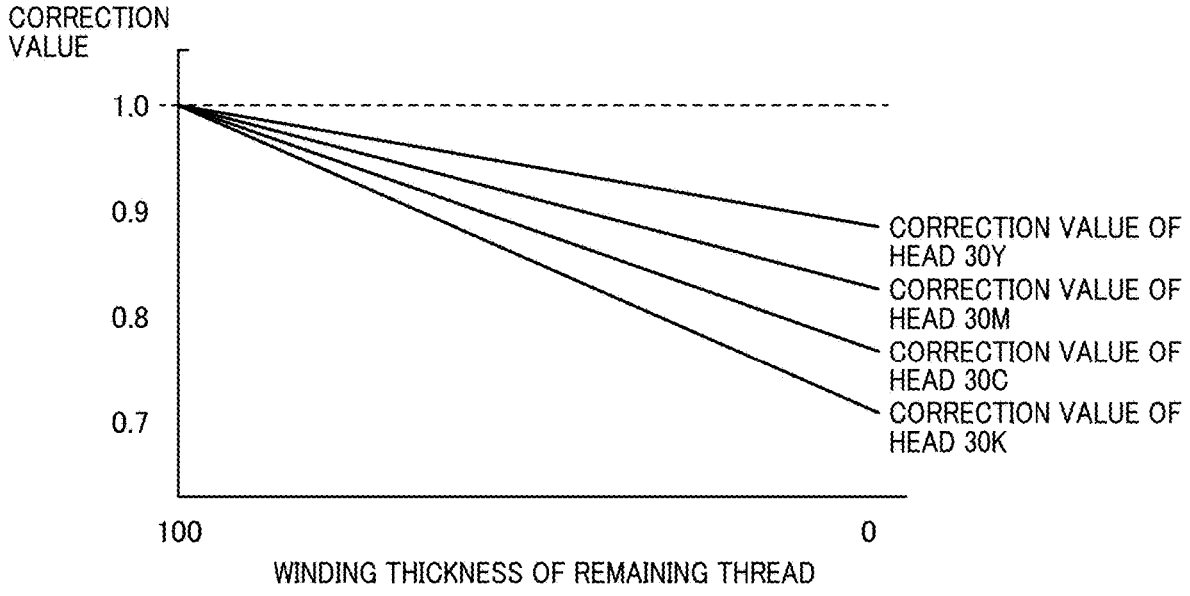
FIG. 6A is a diagram illustrating an example of a correlation table between the winding thickness of the remaining amount of a thread in a supplier and the correction value.
FIG. 6B is a diagram illustrating an example of a correlation graph of the winding thickness and the correction value.

FIG. 6A is a diagram illustrating an example of a correlation table between the winding thickness T of the remaining amount of thread in the supplier and the correction value. As described above, the stronger the winding curl of the thread is, the more easily the dyeing length is elongated on the downstream side. For this reason, when the winding thickness is reduced, the correction value is set so as to shorten the dyeing length as illustrated in the correlation table of FIG. 6A.

Here, the elongation of the thread due to the elongation of the winding curl of the thread is likely to be longer as the feed distance is longer. As illustrated in FIGS. 1 to 3, in the liquid application device 103, the liquid discharge heads 30K, 30C, 30M, and 30Y are arranged in the feed direction of the thread. Accordingly, the feed distance of the thread from the position facing each of the liquid discharge heads 30K, 30C, 30M, and 30Y, which is the dyeing position, to the embroidery head 113 that needs to be aligned is different between the liquid discharge heads 30K, 30C, 30M, and 30Y. Accordingly, even if the thread is unwound from the position of the winding thickness having substantially the same remaining thread amount, a difference occurs in the elongation characteristics after dyeing due to the difference in the inter-unit distance between the embroidery head 113 and each of the liquid discharge heads 30K, 30C, 30M, and 30Y.

Specifically, when the inter-unit distance is short, the amount of change in the length of elongation due to a decrease in the winding thickness of the remaining amount of thread in the supply member 102 decreases. When the inter-unit distance is long, the amount of change in the length of elongation due to a decrease in the winding thickness of the remaining amount of thread increases. Therefore, it is preferable that the correction value according to the winding thickness in the correlation table is set for each head. As illustrated in FIG. 6A, the rate of change of the correction value according to the winding thickness increases as the inter-unit distance between the head and the embroidery head 113 increases on the more upstream side (for example, the liquid discharge head 30K), and the rate of change of the correction value according to the winding thickness decreases on the more downstream side (for example, the liquid discharge head 30Y). The correction value is a magnification to be multiplied when the dyeing length of the initial dyeing data is adjusted.

Second Example of Correction of Dyeing Length

FIG. 6B is a diagram illustrating an example of a correlation graph between the winding thickness of the remaining thread amount of the supplier and the correction value. As described above, the stronger the winding curl of the thread is, the more easily the dyeing length is elongated on the downstream side. For this reason, when the winding thickness is reduced, the correction calculation formula is set so as to shorten the dyeing length as illustrated in the correlation graph.

In the case of setting the correction calculation formula as well, in consideration of the difference in the inter-unit distances, the change rate of the correction value according to the winding thickness is larger for the head on the more upstream side (for example, the liquid discharge head 30K) where the inter-unit distance from the embroidery head 113 is longer, and the change rate of the correction value according to the winding thickness is smaller for the head on the more downstream side (for example, the liquid discharge head 30Y). In the dyeing data in each head using the correction value calculated from the correction calculation formula, when the embroidery head 113 on the downstream side requires the dyeing region having the same length, the correction formula is set for the dyeing length such that the dyeing length of the head on the more upstream side is shorter (30K≤30C≤30M≤30Y) in consideration of the elongation on the downstream side.

Figure 7A:
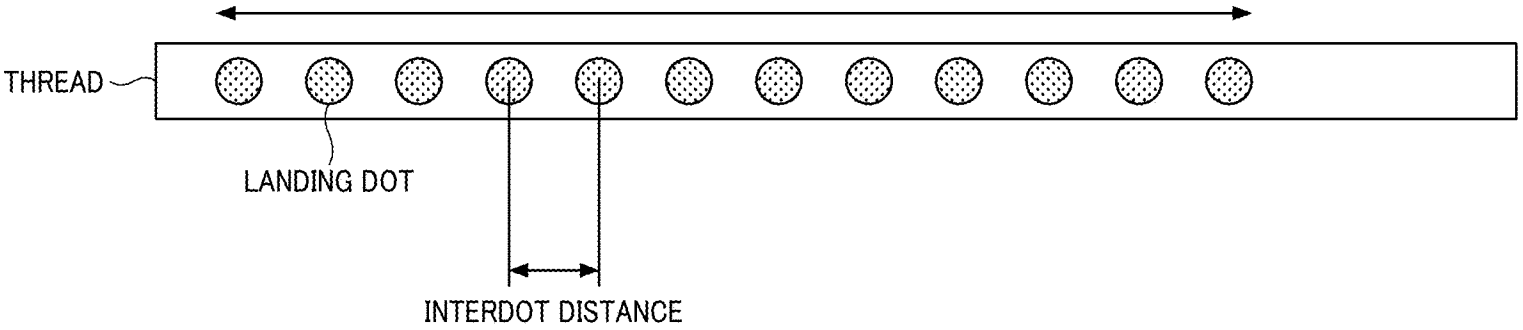
FIGS. 7A and 7B are schematic diagrams illustrating dots on a thread when the thread is dyed based on dyeing data adjusted by the liquid application device of a liquid discharge type according to the first embodiment.
Figure 7B:
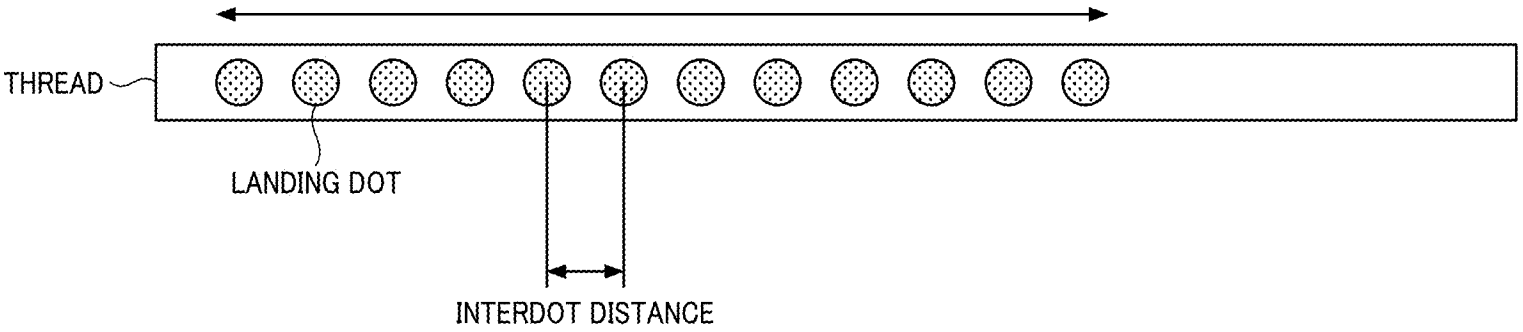

FIGS. 7A and 7B are diagrams schematically illustrating dots on a thread in a case where liquid is discharged at a dyeing length adjusted using a correction value in the liquid-discharge-type liquid application device 103 according to the first embodiment. In FIGS. 7A and 7B, for the sake of explanation, the distance between dots on the thread is illustrated wider than the actual distance. FIG. 7A is a schematic diagram illustrating dots on the thread when the correction value is 1.0. FIG. 7B is a schematic diagram illustrating dots on the thread when the correction value is less than 1.0.

As illustrated in FIG. 7B, even in the case where the dyeing length is changed to be short, it is preferable that the inter-dot distance on the thread is narrowed without changing the number of dots used for dyeing from the number in FIG. 7A. Even if the distance between the dots on the thread at the time of dyeing is different due to the difference in the amount of elongation of the thread on the downstream side of dyeing, which is caused by the difference in the winding outer diameter and the winding thickness of the remaining amount of the thread in the supply member 102, the distance between the dots on the thread is equal in the state in which the thread is elongated on the downstream side.

In FIG. 7, the dots are illustrated to be small with respect to the thread. However, since the dots spread and penetrate inside the thread after landing on the thread, it is preferable that the dot size and the thread width be such that one color can be dyed by one discharge in the width direction of the thread.

As a premise for executing the correction of the dyeing length described above, the winding thickness of the remaining thread amount in the supply member 102 is acquired. As a method of acquiring the winding thickness of the remaining thread amount, for example, there are direct acquisition by detection with a sensor and indirect acquisition by calculation with a calculation formula.

Winding Thickness Detector for Remaining Amount of Thread

Figure 8A:
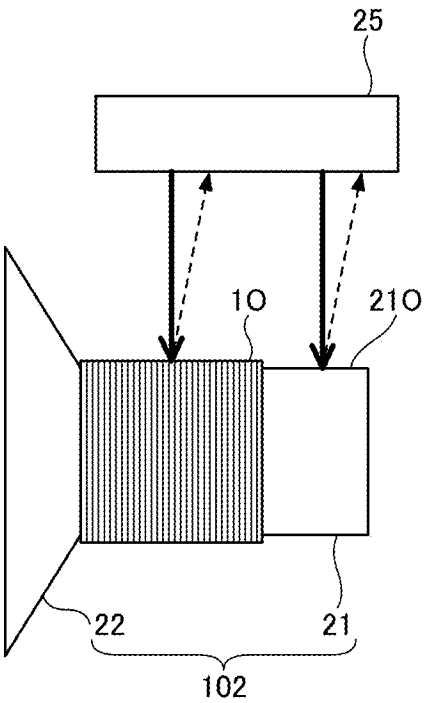
FIGS. 8A, 8B, and 8C are diagrams illustrating examples of a sensor that detects the winding thickness of the remaining amount of a thread in the supplier.
Figure 8B:
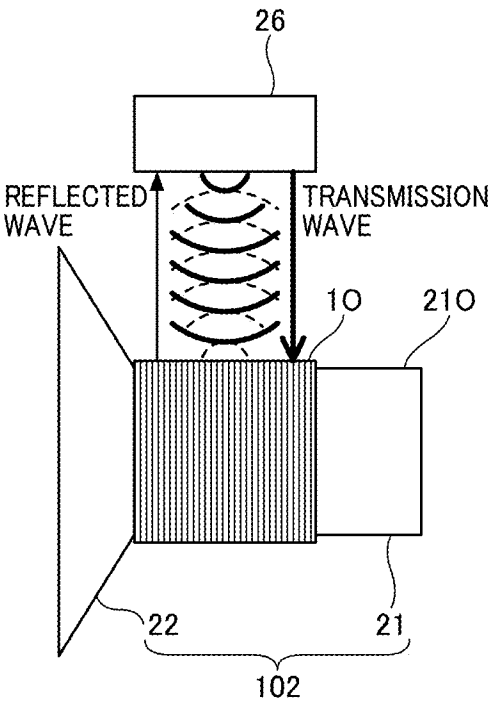
Figure 8C:
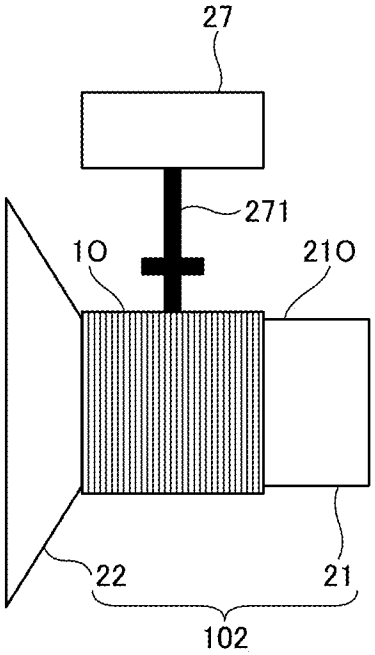

FIGS. 8A, 8B, and 8C are diagrams illustrating an example of a sensor that detects the winding thickness of the remaining amount of thread in the supplier. FIG. 8A illustrates an optical sensor, FIG. 8B illustrates an ultrasonic sensor, and FIG. 8C illustrates a contact sensor as examples of a detector that detects the winding thickness of the remaining amount of thread. FIGS. 8A and 8B illustrate non-contact sensors. FIG. 8C illustrates a contact sensor.

An optical sensor 25 illustrated in FIG. 8A, for example, emits light at two points of a reference position and a measurement position and measures a difference between a light emitting position and a light receiving position at the reference position and a difference between the light emitting position and the light receiving position at the measurement position. At the reference position, light is emitted from the sensor 25 to the outer peripheral core surface 21O of the winding core 21 to measure the distance from the sensor 25 to the outer peripheral core surface 21O. At the measurement position, light is emitted from the sensor 25 to the outermost peripheral remaining-thread surface 1O to detect the distance from the sensor 25 to the outermost peripheral remaining-thread surface 1O. Based on the difference between the distance at the measurement position and the distance at the reference position, the distance of the outermost peripheral remaining-thread surface 1O from the outer peripheral core surface 21O of the winding core 21 is calculated. This distance is the winding thickness of the remaining thread amount that is the thickness of the thread outside the winding core 21.

An ultrasonic sensor 26 illustrated in FIG. 8B, for example, applies a transmission wave to a measurement position and receives a reflected wave and determines the distance from the sensor 26 to the outermost peripheral remaining-thread surface 1O of the thread before the thread is supplied, which is the measurement position, based on the difference in phase between the transmission wave and the reflected wave. The winding thickness of the remaining amount of the thread is detected based on the difference between a previously-input distance from the sensor 26 to the outer peripheral core surface 21O of the winding core 21 and a measured distance between the sensor 26 and the outermost peripheral remaining-thread surface 1O.

In the contact sensor 27 illustrated in FIG. 8C, for example, a telescopic contact terminal 271 constantly contacts the outermost peripheral remaining-thread surface 1O at the outermost side of the remaining amount of the thread. Thus, the distance between the sensor 27 and the outermost peripheral remaining-thread surface 1O of the thread can be determined by the length of the contact terminal. The winding thickness of the remaining amount of the thread is detected based on the difference between a previously-input distance from the sensor 27 to the outer peripheral core surface 21O of the winding core 21 and a measured distance between the sensor 27 and the outermost peripheral remaining-thread surface 1O.

Control Block (First Embodiment)

Figure 9:
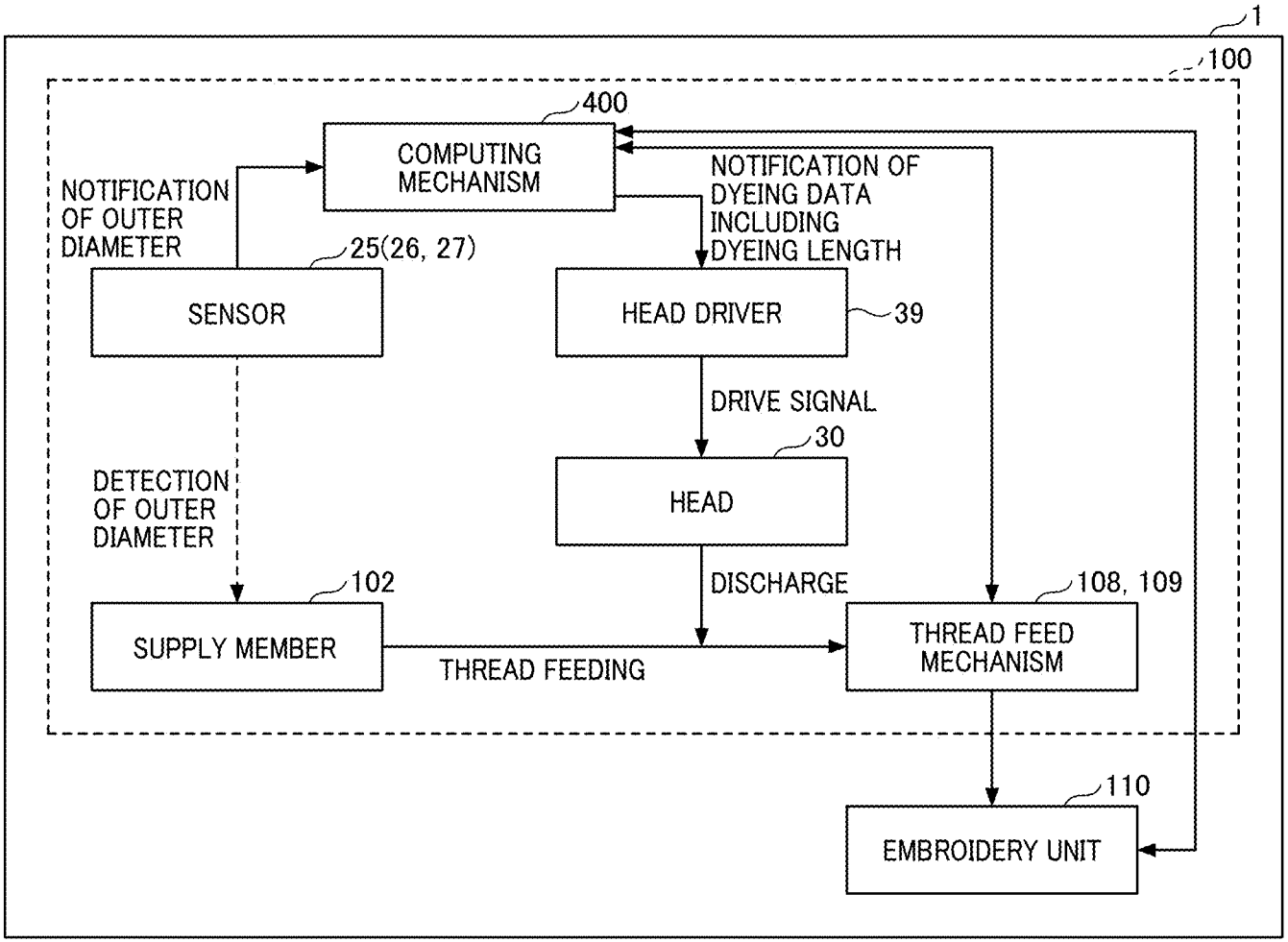
FIG. 9 is a schematic block diagram of the dyeing embroidery apparatus according to the first embodiment.

FIG. 9 is a schematic block diagram of the dyeing embroidery apparatus 1 according to the first embodiment. The dyeing embroidery apparatus 1 includes a computing mechanism 400 and a head driver 39 in addition to the components illustrated in FIG. 1. The computing mechanism 400 functions as a liquid application controller.

The computing mechanism 400 is a main controller of the dyeing embroidery apparatus 1 and is implemented by, for example, an information processing apparatus (computer) such as a central processing unit (CPU).

The head driver 39 drives the liquid discharge heads 30Y, 30M, 30C, and 30K to discharge ink droplets from the nozzles so as to dye the thread at the dyeing length set based on the dyeing data output from the computing mechanism 400.

The embroidery unit 110 is provided with an embroidery-apparatus computing mechanism for executing an embroidery operation based on embroidery data.

First Example of Computing Mechanism

Figure 10:
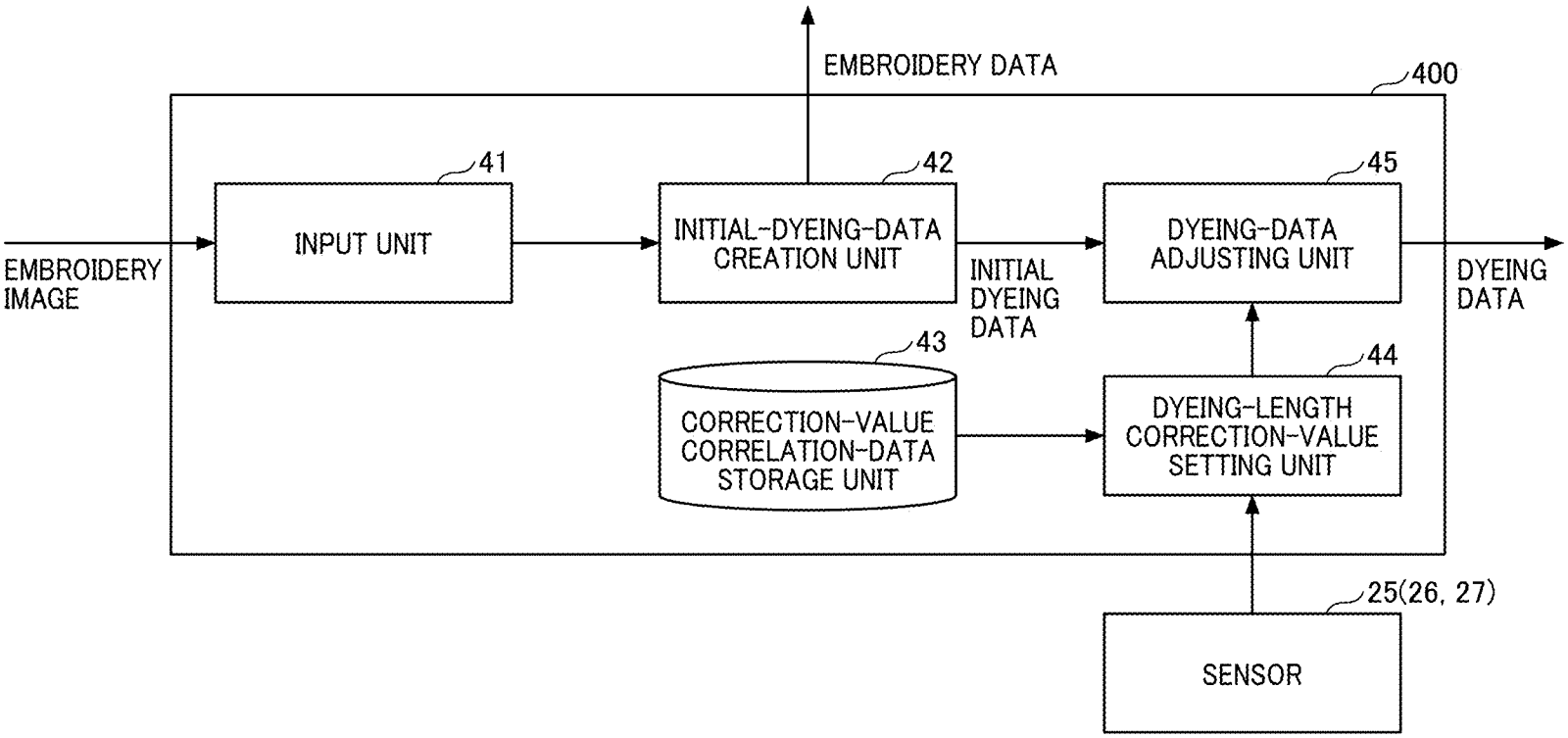
FIG. 10 is a functional block diagram of a computing mechanism according to a first configuration example of the first embodiment.

Details of the computing mechanism 400 are described with reference to FIGS. 10 and 11. FIG. 10 is a functional block diagram of the computing mechanism 400 according to a first configuration example of the first embodiment. As illustrated in FIGS. 8A, 8A, and 8C, the present example is a computing unit in the dyeing embroidery apparatus 1 having a configuration in which the sensor 25 (or the sensor 26 or 27) that detects the winding thickness of the remaining amount of the thread is provided in the vicinity of the supply member 102.

The computing mechanism 400 includes an input unit 41, an initial-dyeing-data creation unit 42, a correction-value correlation-data storage unit 43, a dyeing-length correction-value setting unit 44, and a dyeing-data adjusting unit 45.

The input unit 41 is, for example, a communication unit with an external device and receives an embroidery image. The input unit 41 may be an operation panel or the like. In the case of the operation panel, embroidery data is directly input by an operation of an operator. The embroidery image is image data (embroidery design data) serving as an original of an embroidery pattern on a cloth.

The initial-dyeing-data creation unit 42 processes the embroidery image to create initial dyeing data used in the liquid application unit 100 serving as the dyeing unit and embroidery data used in the embroidery unit 110. The input unit 41 and the initial-dyeing-data creation unit 42 may not be provided inside the dyeing embroidery apparatus 1, and the functions of the input unit 41 and the initial-dyeing-data creation unit 42 may be executed by an external control apparatus (information processing apparatus).

Here, the embroidery data is "data obtained by combining data of coordinates at which the needle is moved and items to be executed at the coordinates". Specifically, the items to be executed at the coordinates include: (1) the needle is inserted into the cloth to catch the upper thread, the needle is returned to the surface of the cloth, and then the needle is moved to the next position to be inserted; (2) the embroidery is ended or interrupted (including switching to another needle and cutting the thread to move to a distant place where the embroidery is not continuous); and (3) the needle is moved to the initialization position (alignment position). As a file of embroidery data, formats such as ".dst" and ".pes" are generally known.

The correction-value correlation-data storage unit 43 stores in advance the correlation table illustrated in FIG. 6A and the correction calculation formula illustrated in the graph illustrated in FIG. 6B. The correction-value correlation-data storage unit 43 may be implemented by, for example, a read only memory (ROM), a random access memory (RAM), or a non-volatile random access memory (NVRAM).

At this time, the correlation data stored by the correction-value correlation-data storage unit 43 as described above is preferably for each head. At this time, the correlation data is set such that the amount of change in the correction value increases as the head is disposed on the more upstream side in the feed direction and decreases as the head is disposed on the more downstream side in the teed direction, so as to align the length of dyeing in the embroidery unit 110 in consideration of the difference in elongation of the thread due to the extension of the winding curl.

The dyeing-length correction-value setting unit 44 sets the correction value of the dyeing length based on the winding thickness of the remaining thread amount in the supply member 102 detected by the sensor 25 serving as the detector and the correlation table or the correction calculation formula stored in the correction-value correlation-data storage unit 43.

The dyeing-data adjusting unit 45 generates dyeing data in which the dyeing length is corrected by multiplying the dyeing length in the dyeing data (initial dyeing data) generated by the initial-dyeing-data creation unit 42 by the correction value set by the dyeing-length correction-value setting unit 44, and outputs the generated dyeing data to the head driver 39.

In the adjustment of the dyeing data, the dyeing-data adjusting unit 45 adjusts the change amount of the correction value to be larger, that is, the dyeing length (liquid application length) in the feed direction on the thread to be shorter for the head disposed on the more upstream side in the feed direction, and adjusts the dyeing length (body application length) in the feed direction on the thread to be longer for the head disposed on the more downstream side in the feed direction.

Second Example of Computing Mechanism

Figure 11:
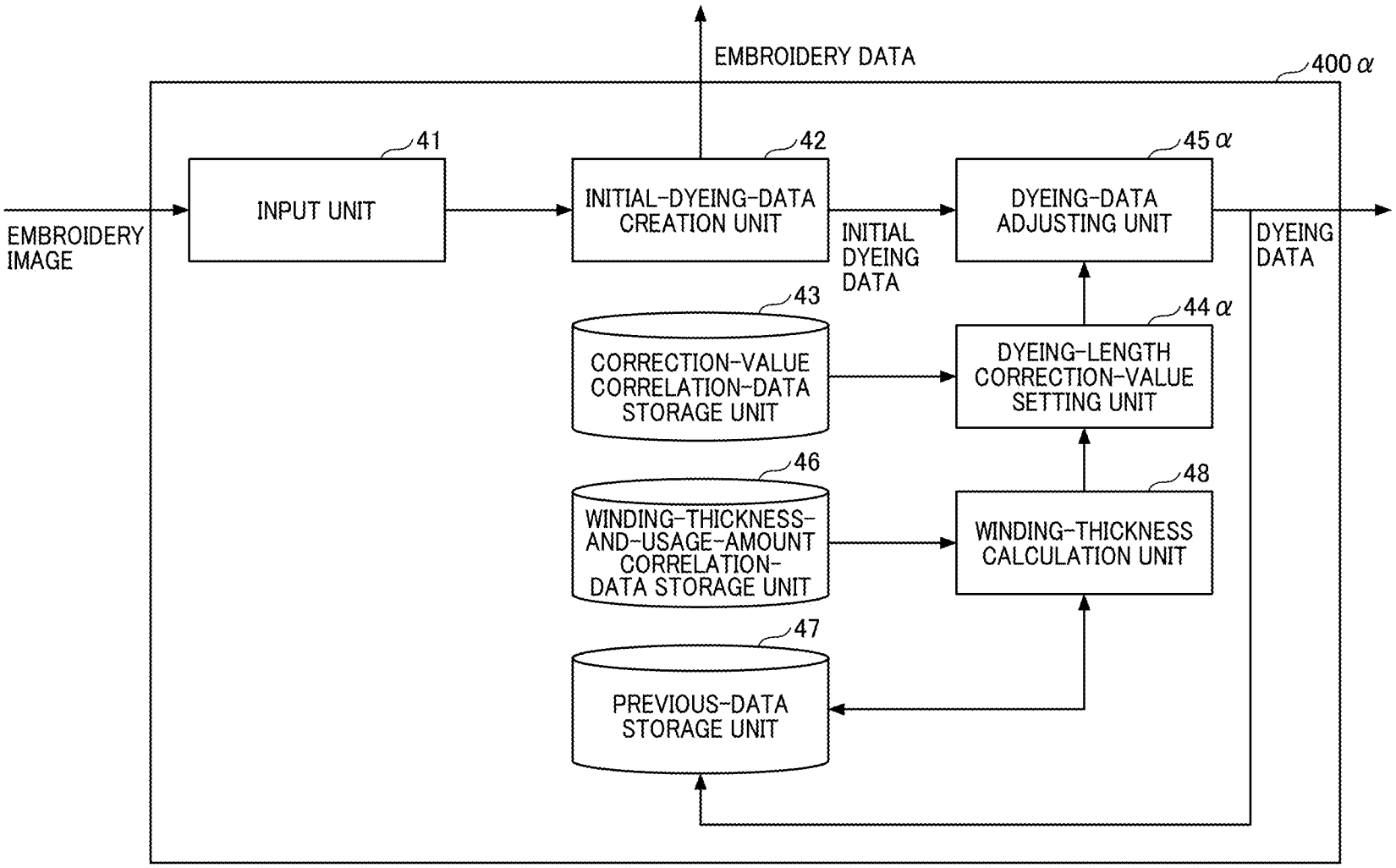
FIG. 11 is a functional block diagram of a computing mechanism according to a second configuration example of the first embodiment.

FIG. 11 is a functional block diagram of a computing mechanism 400α according to a second configuration example of the first embodiment. In this example, the sensor 25 (or the sensor 26 or 27) is not provided in the dyeing embroidery apparatus 1.

In addition to the configuration of FIG. 10, the computing mechanism 400α of the present example includes a winding-thickness-and-usage-amount correlation-data storage unit 46, a previous-data storage unit 47, and a winding-thickness calculation unit 48.

The winding-thickness-and-usage-amount correlation-data storage unit 46 stores in advance correlation data of a correlation table or a correlation calculation formula regarding the total of the dyeing lengths of all colors in the dyeing data and how much the winding thickness of the remaining thread amount in the supply member 102 changes depending on the thread used for dyeing at the dyeing length.

The previous-data storage unit 47 stores the winding thickness of the remaining thread amount at the previous calculation and the previous dyeing data.

The winding-thickness calculation unit 48 calculates the thread usage amount in the previous use from the previous dyeing data stored in the previous-data storage unit 47 and subtracts the calculated thread usage amount from the winding thickness of the remaining thread amount in the previous calculation, to calculate the winding thickness of the current remaining thread amount.

The dyeing-length correction-value setting unit 44α sets the correction value of the dyeing length for each head based on the winding thickness of the remaining thread amount calculated by the winding-thickness calculation unit 48 and the correlation table or the correction calculation formula stored in the correction-value correlation-data storage unit 43.

The dyeing-data adjusting unit 45α multiplies the dyeing length in the initial dyeing data, which is created by the initial-dyeing-data creation unit 42, by the correction value set by the dyeing-length correction-value setting unit 44α to create dyeing data in which the initial dyeing data has been corrected, and outputs the created dyeing data to the head driver 39.

First Control Example

Figure 12:
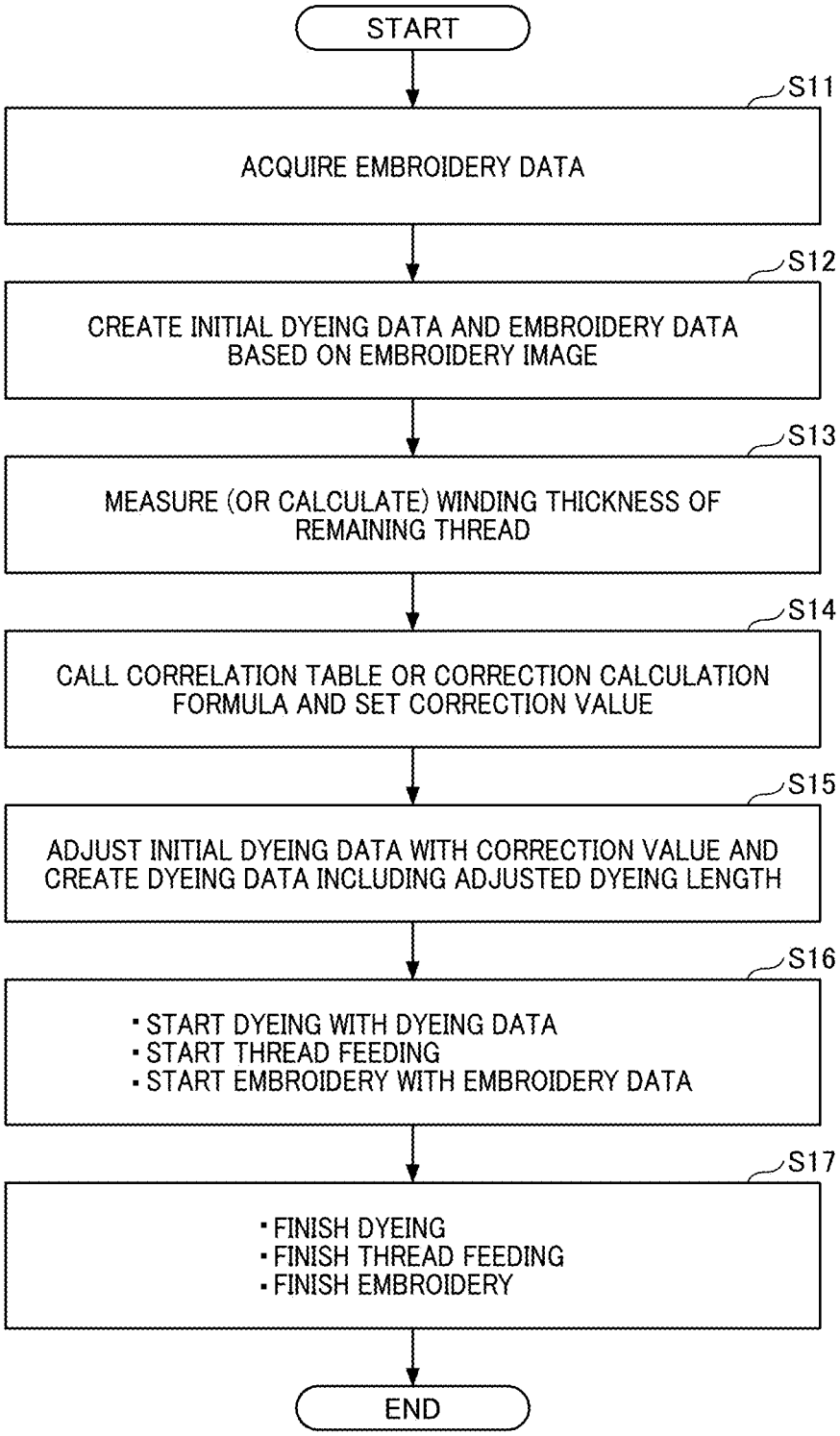
FIG. 12 is a flowchart of thread dyeing according to a first control example of the first embodiment.

FIG. 12 is a flowchart of thread dyeing according to a first control example of the first embodiment of the present disclosure.

First, in step S11 of FIG. 12, the dyeing embroidery apparatus acquires an embroidery image.

In step S12, the initial-dyeing-data creation unit 42 of the computing mechanism 400 creates initial dyeing data and embroidery data based on the embroidery image.

In step S13, the sensor 25 (or the sensor 26 or 27) measures the winding thickness that is the remaining amount of the thread in the supply member 102. As illustrated in FIG. 8A (or 8B or 8C), when the sensor 25 (or the sensor 26 or 27) is provided in the vicinity of the supply member 102, the winding thickness of the remaining thread amount is directly measured. Alternatively, as illustrated in FIG. 11, the winding thickness of the remaining thread amount may be calculated by computing.

In step S14, the dyeing-length correction-value setting unit 44 (44α) of the computing mechanism 400 calls the correlation table or the correction calculation formula, and sets the correction value according to the winding thickness of the remaining thread amount for each head.

The detection or calculation of the winding thicknesses of steps S13 and S14 and the setting of the correction value according to the winding thicknesses may be performed in parallel with step S12 or may be performed before step S12.

In step S15, the dyeing-data adjusting unit 45 of the computing mechanism 400 adjusts the dyeing length for each head by using the correction value set in step S14 for the initial dyeing data created in step S12, to create dyeing data.

In step S16, the feeding of the thread is started according to the embroidery, the dyeing of the thread is started based on the dyeing data, and the embroidery operation is started based on the embroidery data using the dyed thread.

In step S17, the dyeing operation is terminated, the feeding of the thread is stopped, and the embroidery operation is terminated when the embroidery data ends.

As described above, in the dyeing embroidery apparatus 1 according to the present embodiment, the dyeing length (liquid application length) in the dyeing data is adjusted in accordance with the winding thickness of the remaining thread amount at which the characteristic of the winding curl of the thread (linear medium) in the supply member 102 changes. Such a configuration can restrain the occurrence of the applied position shift (color shift) in the embroidery head 113 on the downstream side in the feed direction due to the difference in the strength of the winding curl of the thread (linear medium) in the supply member 102, and enhance the embroidery quality in the embroidery unit 110.

In the first control example illustrated in FIG. 12, the adjustment of the dyeing length according to the winding thickness of the remaining thread amount in the supply member 102 is performed only before the start of dyeing. Such control is suitable for, for example, a case where the remaining amount of the thread of the supply member 102 is large and the amount of the embroidery data is small, and can simplify the control during the dyeing operation.

Second Control Example

Figure 13:
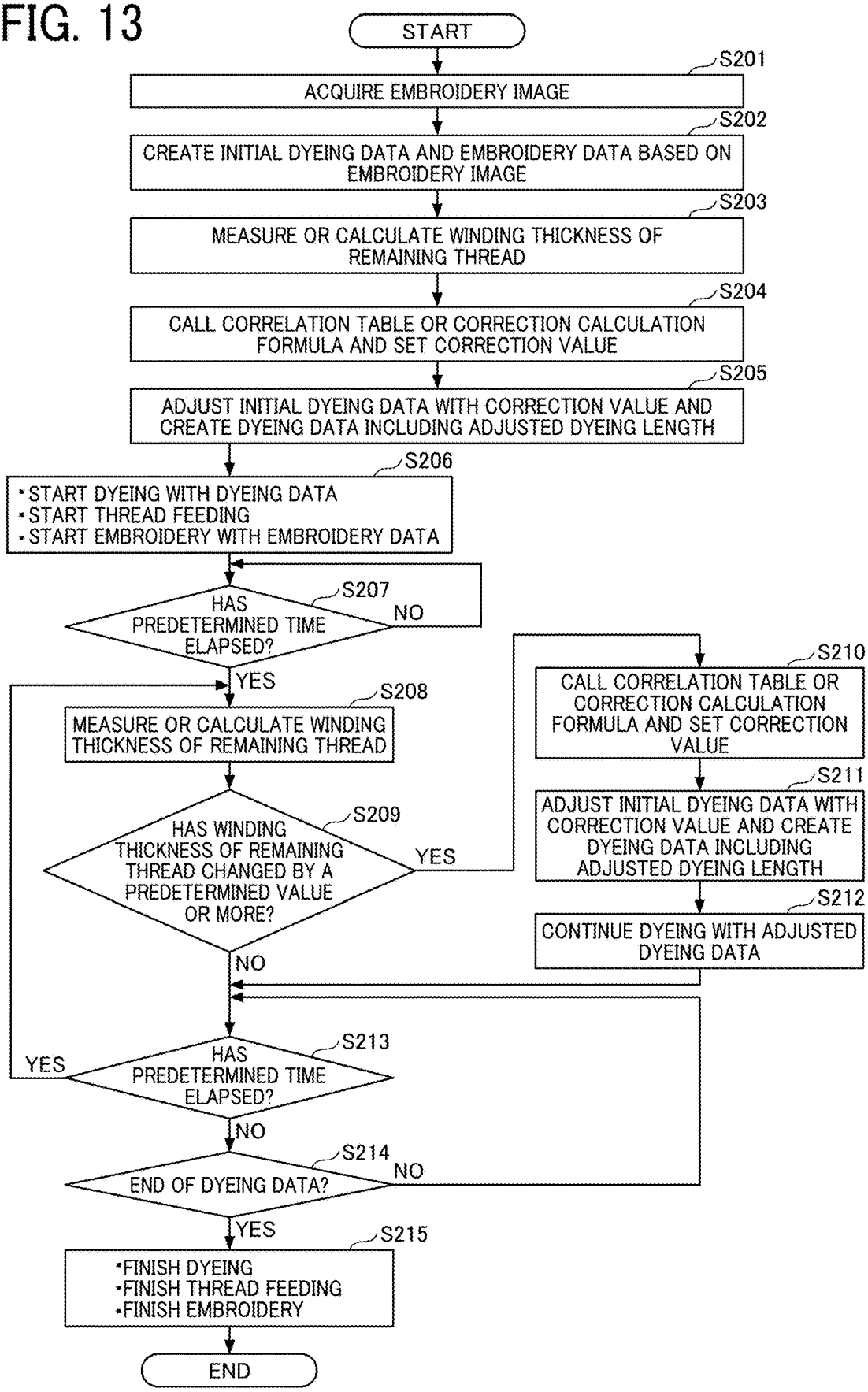
FIG. 13 is a flowchart of thread dyeing according to a second control example of the first embodiment.

FIG. 13 is a flowchart of thread dyeing according to a second control example of the first embodiment of the present disclosure. The present control example is different from the first control example in that the adjustment of the dyeing length according to the winding thickness of the remaining thread amount is also performed during the dyeing operation.

In the flow of FIG. 13, steps S201 to S206 are equivalent to steps S11 to S16 in FIG. 12. In the second control example, control after the start of dyeing is added to the first control example.

When a predetermined time of step S206 elapses (YES in step S207 of FIG. 13), the remaining thread winding thickness is detected or calculated in step S208.

In step S209, when the winding thickness of the remaining thread amount acquired in step S208 has changed by a predetermined value or more with respect to the winding thickness of the remaining thread amount previously acquired in step S203, the process proceeds to step S210. The dyeing-length correction-value setting unit 44 (44α) of the computing mechanism 400 calls a correlation table or a correction calculation formula and sets a correction value corresponding to the winding thickness of the remaining thread amount.

In step S211, the dyeing-data adjusting unit 45 (45α) of the computing mechanism 400 adjusts the dyeing length of the initial dyeing data created in step S202 by using correction values set in step S210.

In step S212, dyeing is performed with the dyeing data readjusted in step S211. Note that it is preferable that the re-adjustment (switching) of dyeing data in step S212 be performed in a period in which the dyeing operation is not performed for the color.

On the other hand, in a case where the winding thickness of the remaining thread amount acquired in step S209 has changed at the predetermined value or less from the winding thickness previously acquired in step S202, the process proceeds to step S213. When the predetermined time elapses again, the process returns to step S208.

When the re-adjustment of the dyeing data is performed in step S212, the process proceeds to the S213, and returns to the S208 after the predetermined time elapses again. On the other hand, if the predetermined time has not elapsed after the readjustment of the dyeing data in step S212, the dyeing operation is continued until the end of the dyeing data in step S214.

When the dyeing operation is completed in step S214, the dyeing operation and the thread feeding operation are terminated in step S215. Then, the embroidery operation is terminated with the end of the embroidery data. In the present flow, an example in which the winding thickness of the remaining thread amount is acquired at every predetermined time has been described. However, the winding thickness may be acquired at all times, and the dyeing length may be readjusted at any time during a period in which there is no dyeing data.

In this control, the winding thickness of the remaining thread amount is also acquired during the dyeing operation, and the adjustment of the dyeing length according to the winding thickness of the remaining thread amount is performed in real time during the dyeing operation so as to offset the difference in the elongation of the thread due to the difference in the winding curl. Such control is effective, for example, when the amount of embroidery is large and the remaining amount of thread in the supply member 102 changes greatly.

Second Embodiment

Figure 14:
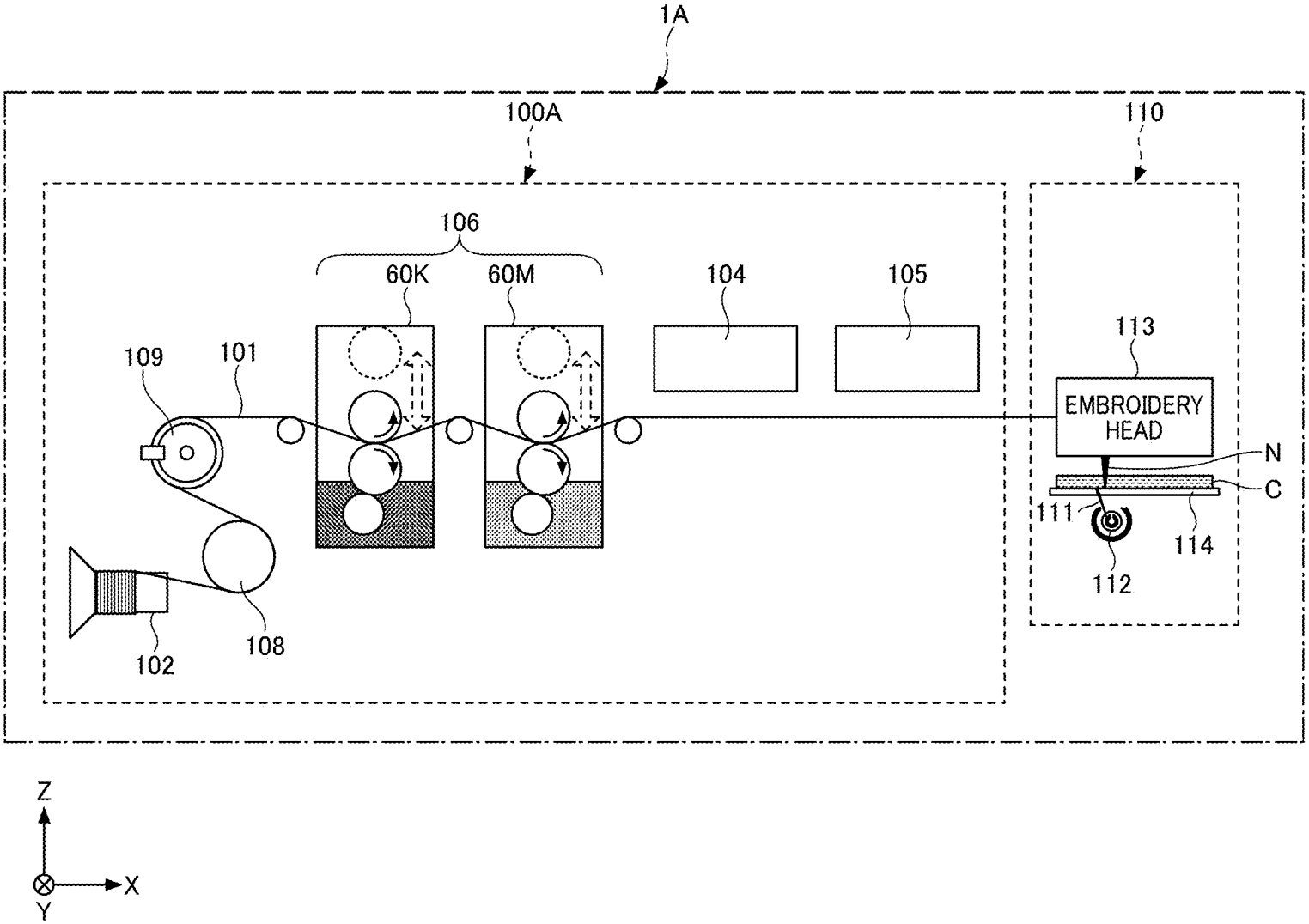
FIG. 14 is a schematic view of a dyeing embroidery apparatus including a liquid application unit according to a second embodiment of the present disclosure.

FIG. 14 is a schematic view of a dyeing embroidery apparatus 1A including a liquid application unit 100A according to a second embodiment of the present disclosure. The liquid application device (dyeing section) 103 of the liquid application unit 100 that is the dyeing unit according to the first embodiment is a liquid droplet discharge type. However, a liquid application device 106 according to the present embodiment is a liquid coating type in which liquid is coated by a roller. FIG. 14 illustrates an example in which two liquid applicator 60K and 60M are provided in the liquid application device 106.

Figure 15A:
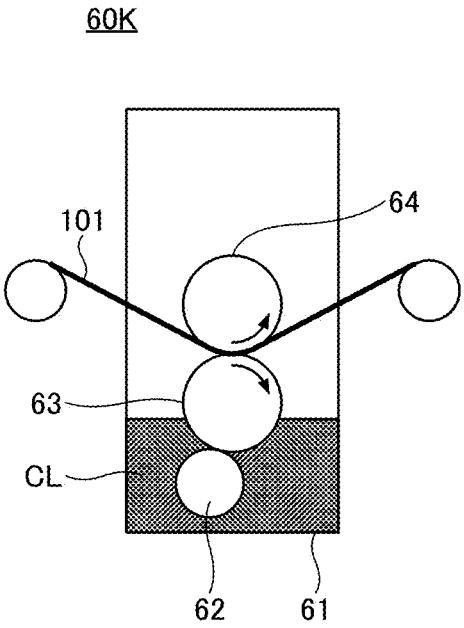
FIGS. 15A and 15B are diagrams illustrating the time of thread dyeing and at the time of non-dyeing in a liquid applicator of a liquid application device of a coating type according to the second embodiment.
Figure 15B:
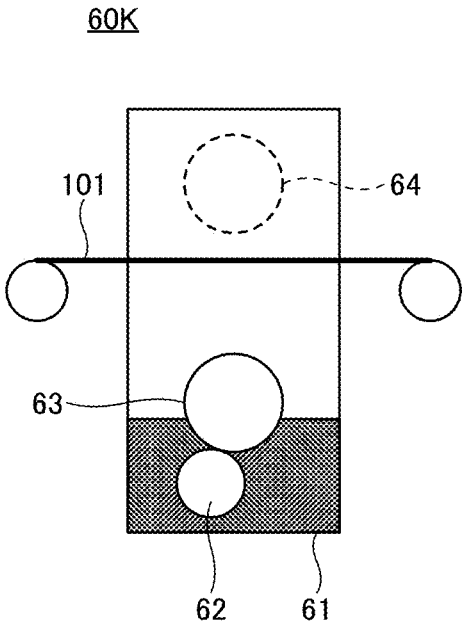

FIGS. 15A and 15B are diagrams illustrating the time of thread dyeing and at the time of non-dyeing in the liquid applicator 60K of the liquid application device 106 of FIG. 14. FIG. 15A is a schematic view of the liquid applicator 60K at the time of dyeing. FIG. 15B is a schematic view of the liquid applicator 60K at the time of non-dyeing.

The liquid applicator 60K of the coating type according to the present embodiment includes, for example, a vessel 61 in which colored liquid CL is accommodated, a squeeze roller 62, a coating roller 63, and a pressure roller 64.

In this configuration, the colored liquid CL is drawn up by the rotation of the squeeze roller 62 driven by a motor. The colored liquid CL drawn up by the squeeze roller 62 is partially scraped off by a nip between the squeeze roller 62 and the coating roller 63 whose periphery is covered with an elastic body such as rubber, and the remaining colored liquid CL is thinly and uniformly spread on the coating roller 63.

The colored liquid CL spread by the coating roller 63 is applied to a thread 101 sandwiched at a coating nip formed by the pressure roller 64 and the coating roller 63.

In the liquid applicator 60K, the pressure roller 64 is movable in the vertical direction. As illustrated in FIG. 15A, in a state in which the pressure roller 64 is lowered, the pressure roller 64 and the coating roller 63 contact each other, sandwich the thread 101 to form the coating nip and perform a dyeing operation.

On the other hand, as illustrated in FIG. 15B, in the state in which the pressure roller 64 is raised, the pressure roller 64 is separated from the coating roller 63 and is also separated from the thread 101. In this state, the thread 101 does not contact the pressure roller 64 or the coating roller 63, and the dyeing operation is not performed.

In the present embodiment, in a case where the dyeing length on the thread is adjusted, a period in which the coating nip is formed by sandwiching the thread 101 is adjusted by adjusting the lifting and lowering of the pressure roller 64. As illustrated in FIG. 14, in the liquid application device 106, the liquid applicators 60K and 60M are arranged in the feed direction. Therefore, it is preferable to set the correction value according to the winding thickness in the correlation table or the correction value calculation formula for each of the liquid applicators 60K and 60M. FIG. 14 illustrates the example in which two liquid applicators 60K and 60M are provided. However, two or more liquid applicators may be provided in the configuration of the second embodiment.

In the dyeing embroidery apparatus 1A according to the present embodiment having such a configuration, the dyeing length (liquid application length) in the dyeing data is adjusted according to the winding thickness of the remaining amount of thread in the supply member 102. Such a configuration can restrain the occurrence of the application position shift (color shift) in the embroidery head 113 on the downstream side in the feed direction, which is due to the difference in the strength of the winding curl of the thread (linear medium) in the supply member 102, and enhance the embroidery quality in the embroidery unit 110.

Third Embodiment

Figure 16:
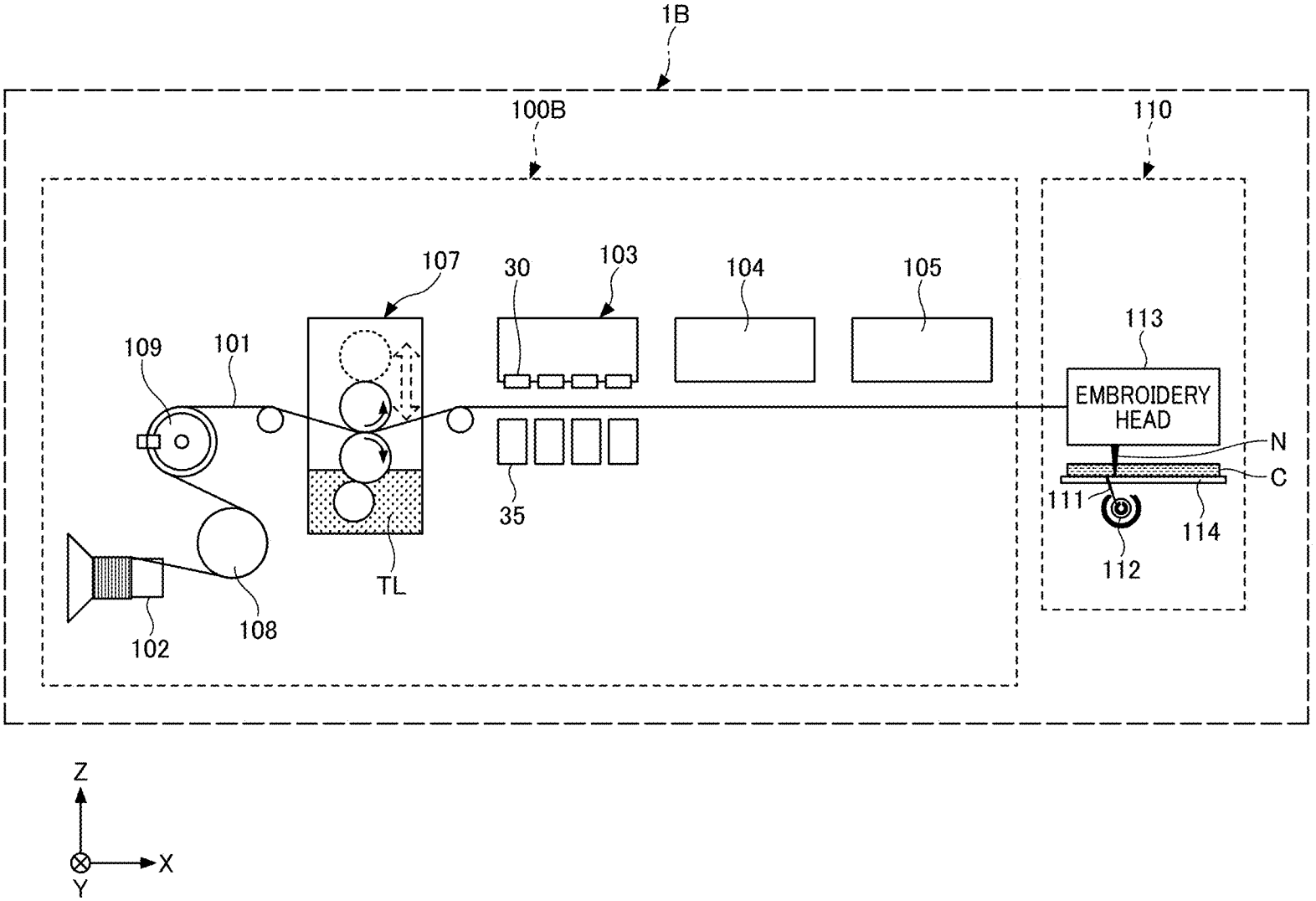
FIG. 16 is a schematic view of a dyeing embroidery apparatus including a liquid application unit according to a third embodiment of the present disclosure.

FIG. 16 is a schematic view of a dyeing embroidery apparatus 1B including a liquid application unit 100B according to a third embodiment of the present disclosure. The present embodiment is different from the first embodiment in that a pretreatment-liquid applicator 107 is provided in the liquid application unit 100B in addition to the configuration of the first embodiment.

The configuration of the pretreatment-liquid applicator 107 is substantially the same as the configuration of the liquid applicator 60 of the coating type illustrated in FIGS. 15A and 15B except that the liquid to be stored is a pretreatment liquid TL that is a transparent liquid. The pretreatment liquid applied by the pretreatment-liquid applicator 107 is applied in accordance with the region to which the liquid is applied in the liquid application device 103 in the subsequent stage.

Figure 17:
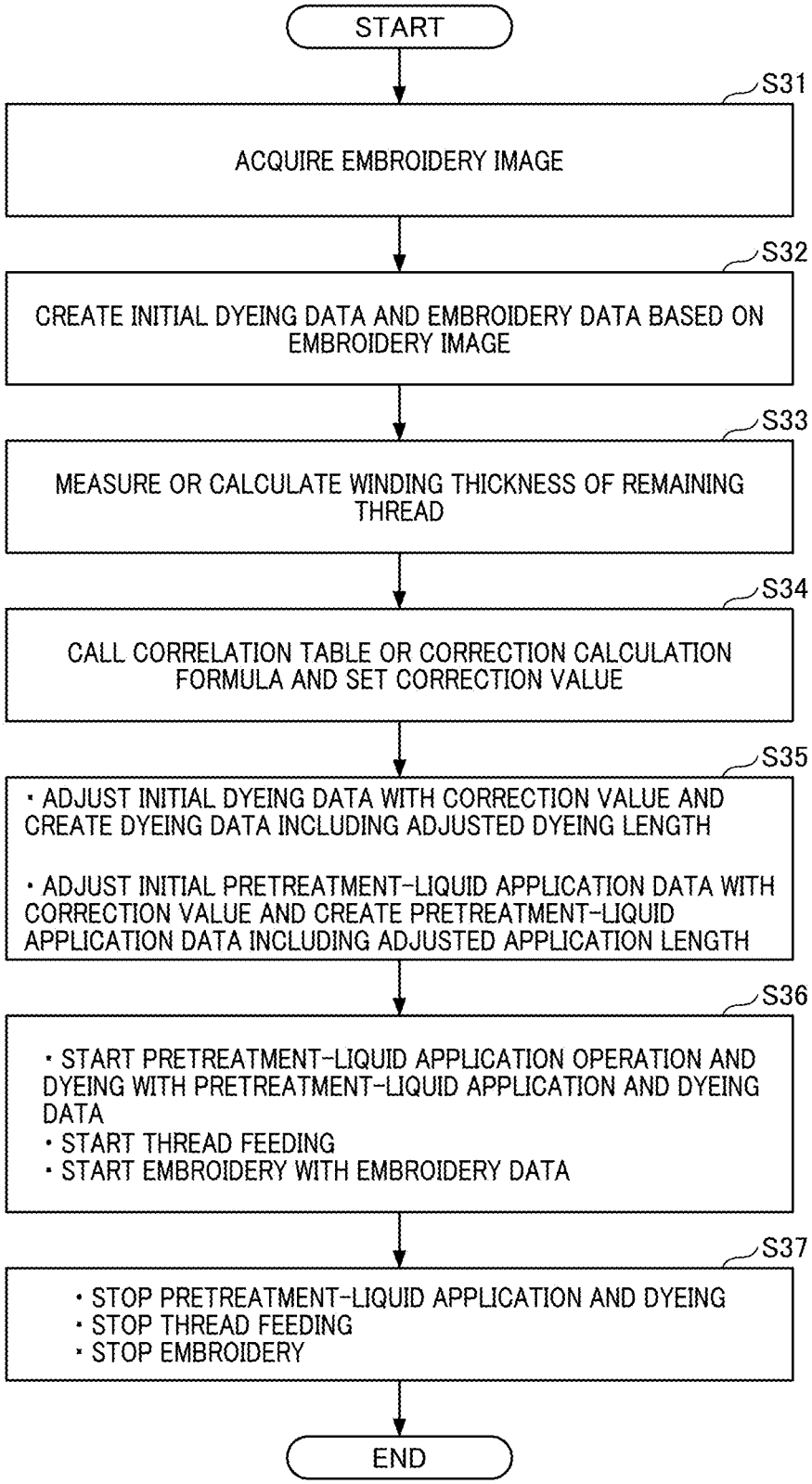
FIG. 17 is a flowchart of thread dyeing according to the third embodiment.

FIG. 17 is a flowchart of thread dyeing according to a third embodiment. The process flow is the same as the process flow in FIG. 12 described above, but is different in that pretreatment-liquid application data is controlled together with dyeing data.

In step S32, initial pretreatment-liquid application data is created in accordance with initial dyeing data when the initial dyeing data is created based on embroidery data.

In step S34, the initial dyeing data and the initial pretreatment-liquid application data are corrected with the correction value set based on the winding thickness in step S34, and the dyeing data including adjusted dyeing length and the pretreatment-liquid application data including adjusted application length are created. Since the pretreatment-liquid applicator 107 is positioned further upstream than the most-upstream liquid discharge head 30K, the rate of change of the correction value is set to be larger than that of the most-upstream liquid discharge head 30K. Therefore, when the pretreatment liquid is applied with the same length as the dyeing length, the adjusted application length is set to be shorter than the dyeing length of each color.

Thereafter, the pretreatment-liquid application operation is performed using the pretreatment-liquid application data, the dyeing operation is performed using the dyeing data, and the embroidery operation is started based on the embroidery data using the dyed thread (Step S35). When the dyeing data is finished (step S36), the dyeing and feeding operations are finished in step S37. Then, the embroidering operation is finished.

In FIG. 17, the flow of performing the same control as the first control example in which the correction value of the dyeing length is set before the start of dyeing has been described. In the control according to the present embodiment, the dyeing length may be adjusted in real time during the dyeing operation as in the second control example.

With such a configuration, in the dyeing embroidery apparatus 1B according to the present embodiment, the dyeing length (liquid application length) and the application length of the pretreatment liquid in the dyeing data is adjusted according to the winding thickness of the remaining amount of thread in the supply member 102. Such a configuration can restrain the occurrence of the application position shift (color shift) in the embroidery head 113 on the downstream side in the feed direction, which is due to the difference in characteristic of the strength of the winding curl of the thread (linear medium) in the supply member 102, and enhance the embroidery quality in the embroidery unit 110.

Fourth Embodiment

Figure 18:
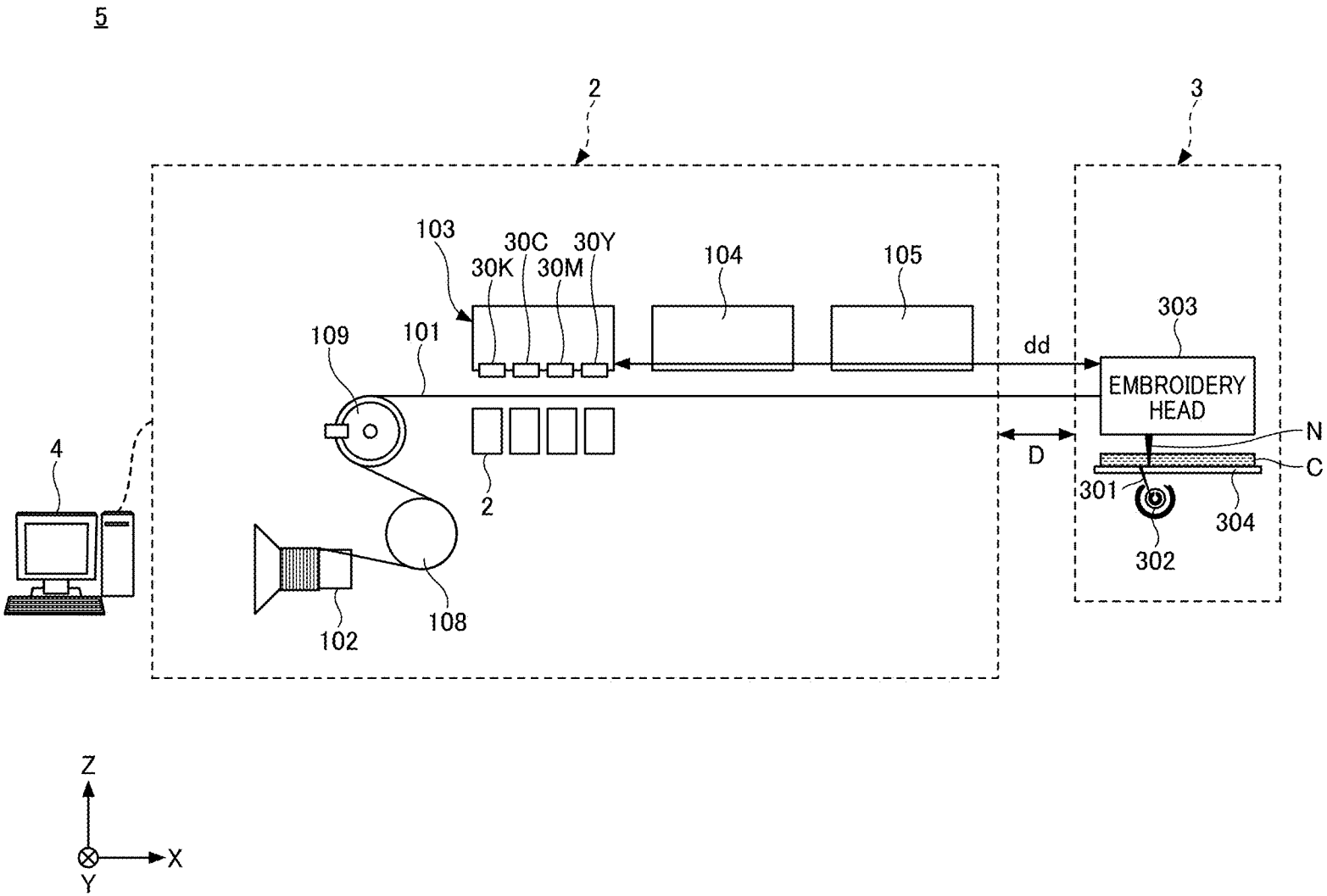
FIG. 18 is a schematic view of a dyeing embroidery system including a dyeing apparatus and an embroidery apparatus according to a fourth embodiment of the present disclosure.

FIG. 18 is a schematic view of a dyeing embroidery system including a dyeing apparatus and an embroidery apparatus according to a fourth embodiment of the present disclosure. In the first to third embodiments, the dyeing unit and the embroidery unit are devices in one housing. Alternatively, dyeing and embroidery in an embodiment of the present disclosure may be separate devices provided in separate housings.

As illustrated in FIG. 18, a dyeing embroidery system 5 according to the present embodiment includes a dyeing apparatus 2, an embroidery apparatus 3, and a control apparatus 4. The dyeing apparatus 2 has a configuration and function equivalent to liquid application unit 100 serving as the dyeing unit described above, and the embroidery apparatus 3 has a configuration and function equivalent to the embroidery unit 110 described above.

However, in the present embodiment, since the dyeing apparatus 2 and the embroidery apparatus 3 are surrounded by separate housings, the inter-apparatus distance D between the dyeing apparatus 2 and the embroidery apparatus 3 changes according to the layout of the apparatuses. When the layout of the inter-apparatus distance D is changed, the inter-unit distance dd between the liquid application device 103 serving as the dyeing section and the embroidery head 303 is also changed. When the distance dd changes, the feed distance of the dyed thread also changes. As the feed distance of the thread increases, the difference in elongation in the downstream direction due to the difference in winding outer diameter at the time of winding the thread increases.

Therefore, in the present embodiment, the dyeing length is adjusted in consideration of the inter-unit distance dd corresponding to the inter-apparatus distance D between the dyeing apparatus 2 and the embroidery apparatus 3, which varies depending on the layout of the apparatuses.

Figure 19:
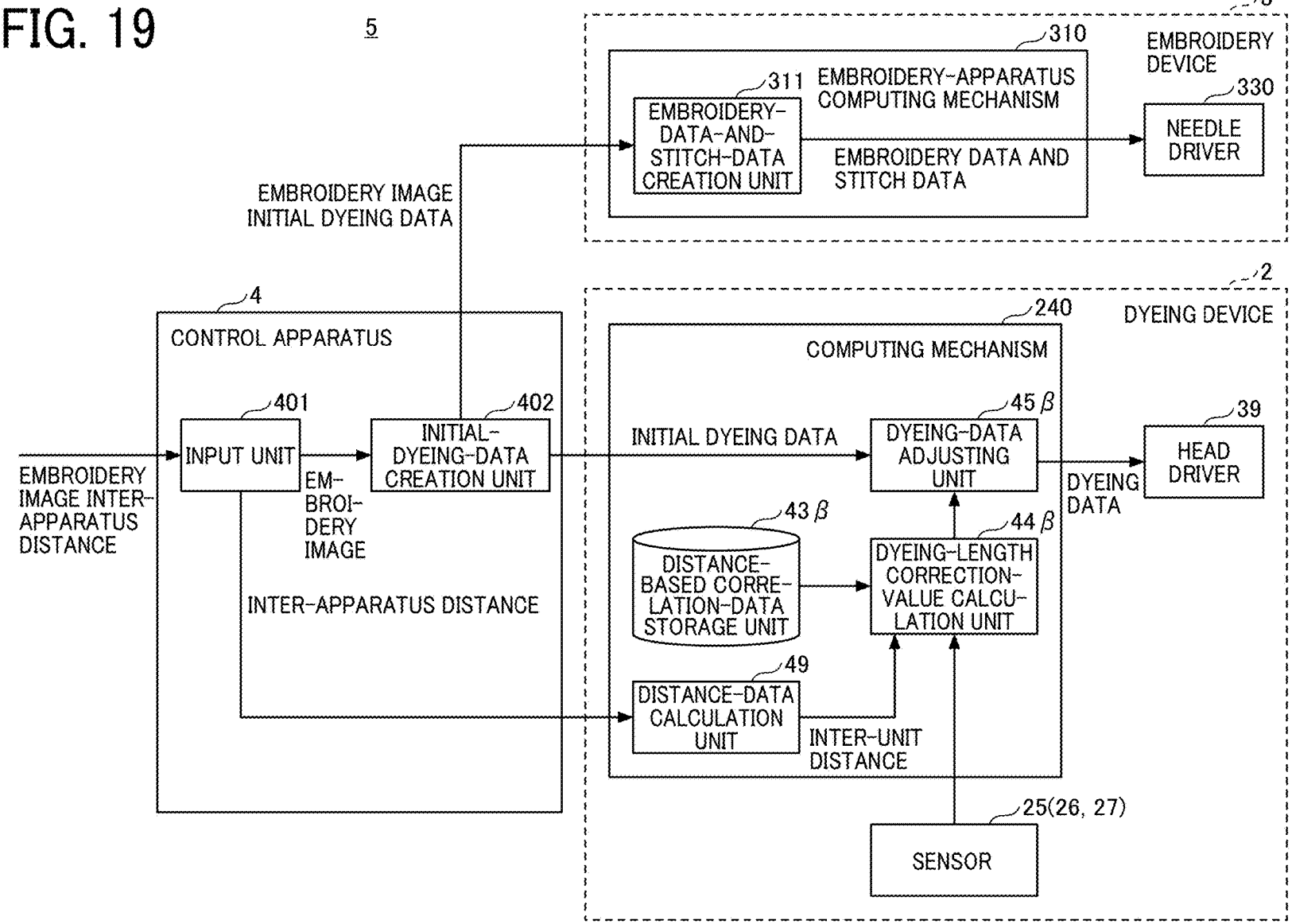
FIG. 19 is a functional block diagram of a computing mechanism according to the fourth embodiment.
Figure 20A:
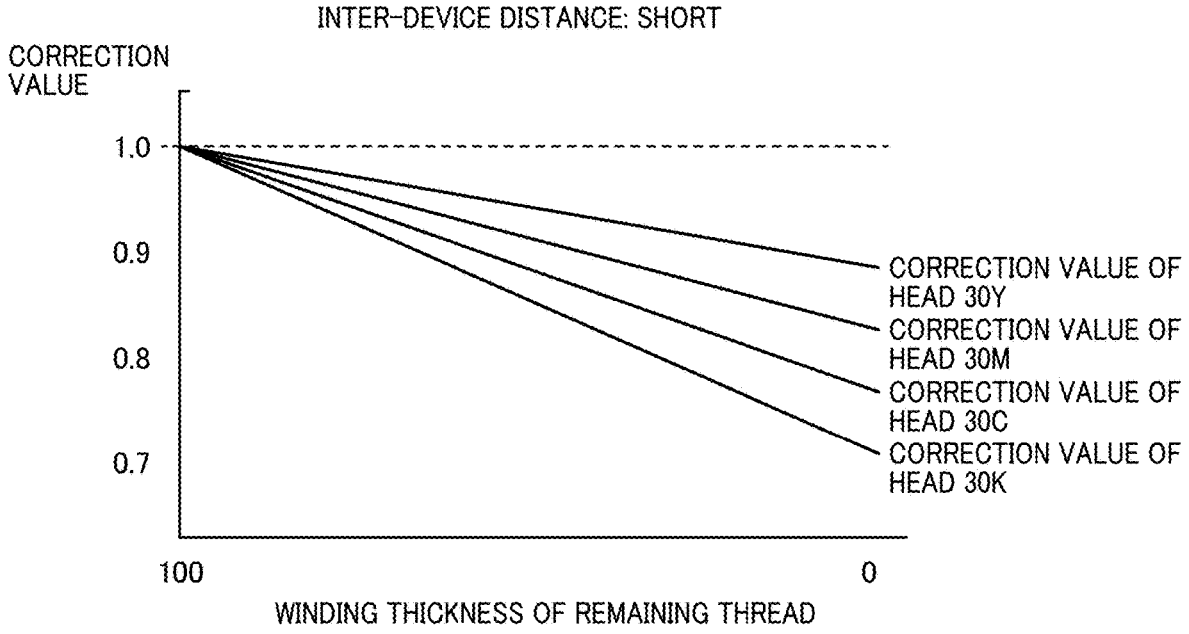
FIGS. 20A and 20B are diagrams illustrating examples of a correlation graph between the winding thickness of the remaining amount of a thread and the correction value when the inter-apparatus distance between the dyeing apparatus and the embroidery apparatus changes in the fourth embodiment.
Figure 20B:
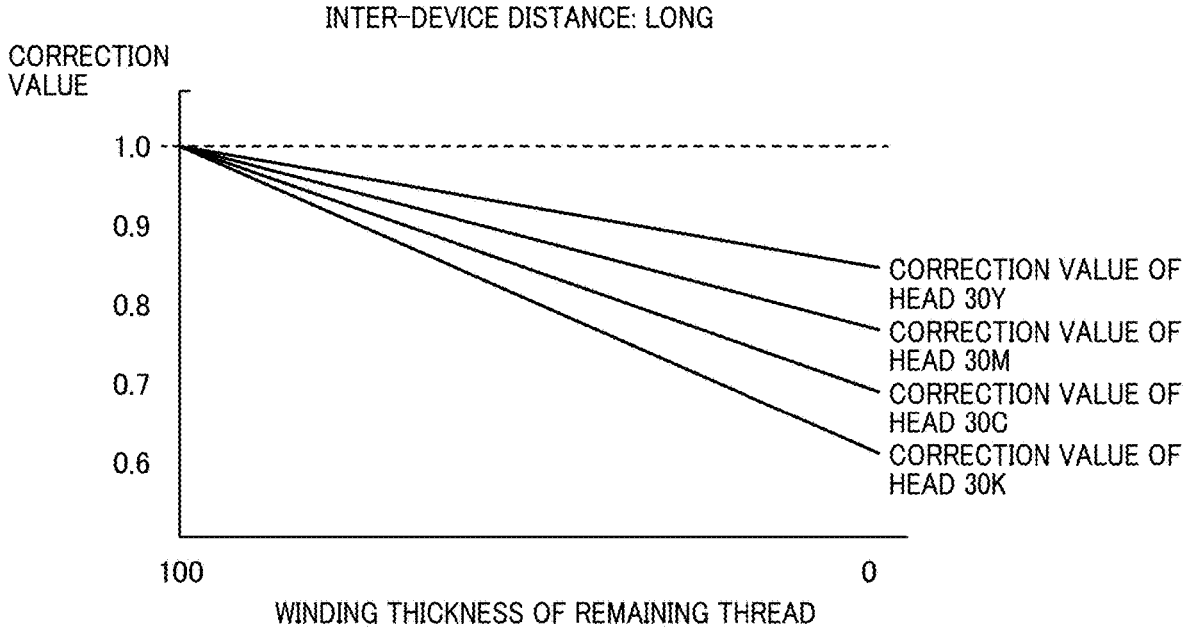

FIG. 19 is a functional block diagram of a section related to dyeing control in the dyeing embroidery system 5 according to a fourth embodiment. FIGS. 20A and 20B are diagrams illustrating examples of a correlation graph between the winding thickness of the remaining thread amount and the correction value when the inter-apparatus distance between the dyeing apparatus and the embroidery apparatus changes in the fourth embodiment.

The control apparatus 4 includes an input unit 401 and an initial-dyeing-data creation unit 402. The control apparatus 4 is, for example, an information processing apparatus (personal computer or PC). The inter-apparatus distance D is input to the input unit 401 together with the embroidery data. The input unit 401 is an operation unit or a communication unit capable of communicating with another apparatus via a network such as the Internet.

The dyeing apparatus 2 is different from the above-described embodiment in that the dyeing data is adjusted in consideration of the inter-apparatus distance in the calculation mechanism 240. The calculation mechanism 240 includes a distance information calculation unit 49 and calculates the inter-unit distance dd from the inter-apparatus distance D.

The distance-based correlation-data storage unit 43β stores correlation data corresponding to the inter-unit distance dd. The correlation data is a plurality of correction calculation formulas or a plurality of correlation tables. FIG. 20 is a graph illustrating the correction calculation formula stored in the distance-based correlation-data storage unit 43β.

FIG. 20A is a graph illustrating the relationship between the winding thickness of the remaining thread amount and the correction value when the inter-device distance is short. FIG. 20B is a graph illustrating the relationship between the winding thickness and the correction value when the inter-apparatus distance is long. When the inter-apparatus distance is short, the change amount of the correction value due to the decrease in the winding thickness is set to be small as illustrated in FIG. 20A. When the inter-apparatus distance is long, the change amount of the correction value due to the decrease in the winding thickness is set to be large as illustrated in FIG. 20B. This is because the longer the inter-apparatus distance and the longer the feed distance, the more the amount of elongation of the thread due to the extension of the winding curl increases.

In the control according to the present embodiment in consideration of the inter-apparatus distance, the liquid discharge heads 30K, 30C, 30M, and 30Y are arranged in the feed direction in the liquid application device 103 and the distances from the liquid discharge heads 30K, 30C, 30M, and 30Y to the embroidery head 303 are different from each other. Therefore, it is preferable to set the correction value corresponding to the winding thickness in the correction calculation formula for each of the liquid discharge heads 30K, 30C, 30M, and 30Y. The dyeing-data adjusting unit 45*b* outputs the dyeing-data corrected according to the inter-unit distance dd and the winding thickness to the head driver 39 of each of the liquid discharge heads 30K, 30C, 30M, and 30Y.

In the case of setting the correlation table, similarly, numerical values are stored in advance so that when the inter-apparatus distance is short, the amount of change in the correction value due to the decrease in the winding thickness is small, and when the inter-apparatus distance is long, the amount of change in the correction value due to the decrease in the winding thickness is large.

The embroidery apparatus 3 includes an embroidery-apparatus computing mechanism 310 that is a controller, and a needle driver 330 that drives a needle. The embroidery-data-and-stitch-data creating unit 311 in the embroidery-apparatus computing mechanism 310 acquires an embroidery image and initial dyeing data created by the initial-dyeing-data creation unit 402, and creates the embroidery data and the stitch data. The stitch data is data only for needle drop, which instructs the needle driver 330 for driving the needle N as to where to drop (stick) the needle next.

Figure 21:
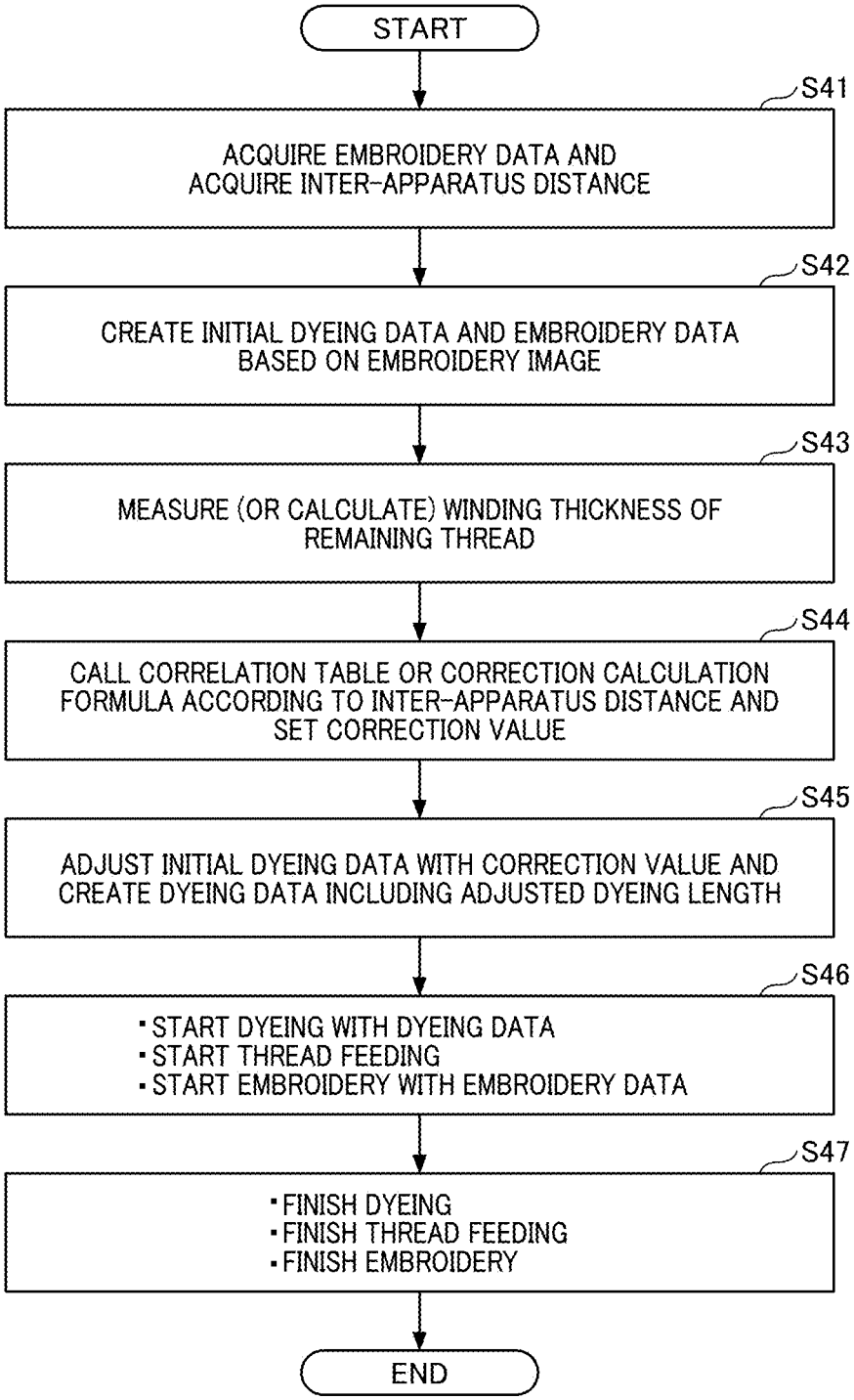
FIG. 21 is a flowchart of thread dyeing according to the fourth embodiment.

FIG. 21 is a flowchart of thread dyeing according to a fourth embodiment. In the present embodiment, in step S41, the inter-apparatus distance D is acquired together with an embroidery image. The inter-apparatus distance D may be manually measured and input by the operator, or may be measured by a distance measurement sensor provided in one of the apparatuses. Note that the inter-apparatus distance in step S41 is acquired only alter the layout change of the apparatuses. Thereafter, if the apparatuses are not changed, values acquired before the previous time and stored in advance are called and used.

In step S42, the initial dyeing data and the embroidery data are created in the same manner as in step S12.

After the winding thickness of the remaining amount of the thread in the supply member 102 is measured or calculated in step S43, a correlation table or a correction calculation formula corresponding to the inter-apparatus distance (or inter-unit distance) is called to set a correction value in step S44. Steps S43 and S44 may be performed in parallel with step S42 or may be performed before step S42.

In step S45, the dyeing length in the initial dyeing data is adjusted with the correction value calculated in consideration of the inter-apparatus distance (or inter-unit distance). Thus, dyeing data including adjusted dyeing length is created.

Thereafter, the dyeing operation and the feeding operation are performed based on the dyeing data, and the embroidery operation is performed based on the embroidery data by using the dyed upper thread (step S46). The dyeing operation and the conveying operation are finished when the dyeing data ends, and the embroidering operation is finished when the embroidery data ends (step S47).

In FIG. 21, the flow of performing control similar to the first control example in which the correction value of the dyeing length is set before the start of dyeing has been described. In the present embodiment, since the apparatus does not move during the dyeing operation, the adjustment of the dyeing length in real time according to the inter-apparatus distance is not performed during the dyeing operation as in the second control example. This control is executed only before the start or immediately after, for example, the layout between the apparatuses is changed. In a case where the dyeing apparatus and the embroidery apparatus are configured as separate devices, the readjustment of the dyeing length according to the decrease in the remaining amount of the thread in the supplier may be performed during the dyeing operation as in the second control example.

With such a configuration and control, in the dyeing embroidery system 5 according to the present embodiment, the dyeing length (liquid application length) in the dyeing data is adjusted in accordance with the winding thickness of the remaining amount of the thread in the supply member 102. Such a configuration can restrain the occurrence of the application position shift (color shift) in the embroidery head 303 of the embroidery apparatus 3 on the downstream side in the feed direction, which is due to the difference in the winding curl of the thread (linear medium) in the supply member 102, and enhance the embroidering quality the embroidery apparatus 3.

Although some embodiments and examples of the present disclosure have been described above, embodiments of the present disclosure are not limited to the above-described embodiments and examples. Various modifications and enhancements are possible in light of the above teachings, without departing from the scope of the present disclosure.

The invention claimed is:

1. A liquid application unit, comprising:

a supply member including a cylindrical or columnar winding core around which a linear medium is wound;

a liquid application device configured to apply liquid to the linear medium unwound and fed from the supply member; and an application controller configured to adjust a liquid application length of the liquid applied by the liquid application unit to the linear medium in a feed direction of the linear medium, the application controller being configured to adjust the liquid application length in the feed direction of the linear medium in accordance with a winding thickness of a remaining amount of the linear medium from an outer peripheral surface of the winding core.

2. The liquid application unit according to claim 1, wherein the liquid applied by the liquid application device includes a plurality of colored dyeing liquids to dye the linear medium with adjusted dyeing lengths at positions different from each other in the feed direction.

3. The liquid application unit according to claim 1, wherein the application controller is configured to adjust the liquid application length on the linear medium in the feed direction to be shorter as the winding thickness of the remaining amount of the linear medium is thinner.

4. The liquid application unit according to claim 1, wherein the application controller is configured to adjust the liquid application length in the feed direction in accordance with the winding thickness of the remaining amount of the linear medium at a time point at which the linear medium starts to be unwound for a start of liquid application.

5. The liquid application unit according to claim 1, wherein the application controller is configured to adjust the liquid application length in the feed direction in accordance with the winding thickness of the remaining amount of the linear medium at a time point at which the linear medium is unwound during liquid application.

6. The liquid application unit according to claim 1, wherein the liquid application device includes a plurality of liquid applicators aligned in the feed direction, and wherein the application controller is configured to adjust the liquid application length on the linear medium in the feed direction for each of the plurality of liquid applicators.

7. The liquid application unit according to claim 6, wherein the application controller is configured to adjust the liquid application length on the linear medium in the feed direction to be shorter as a liquid applicator of the plurality of liquid applicators is disposed more upstream in the feed direction.

8. The liquid application unit according to claim 1, further comprising a detector configured to detect the winding thickness of the remaining amount of the linear medium from the outer peripheral surface of the winding core, wherein the application controller is configured to adjust the liquid application length on the linear medium in the feed direction according to the winding thickness detected by the detector, and wherein the detector is an optical sensor, an ultrasonic sensor, or a contact sensor.

9. The liquid application unit according to claim 1, further comprising:

a correlation memory configured to store in advance correlation data between a feed length of the linear medium to be used and a change amount of the winding thickness of the remaining amount of the linear medium from the outer peripheral surface of the winding core; and a calculator configured to calculate the winding thickness from the feed length of the linear medium to be used, wherein the application controller is configured to adjust the liquid application length of the linear medium in the feed direction according to the winding thickness calculated by the calculator.

10. A control method for a liquid application apparatus that includes: a supply member including a cylindrical or columnar winding core around which a linear medium is wound; and a liquid application device configured to apply liquid to the linear medium unwound and fed from the supply member, the control method comprising:

detecting or calculating a winding thickness of a remaining amount of the linear medium from an outer peripheral surface of the winding core;

adjusting a liquid application length of the liquid applied by the liquid application device to the linear medium in a feed direction of the linear medium in accordance with the winding thickness of the remaining amount of the linear medium; and applying, by the liquid application device, the liquid to the linear medium being fed at the liquid application length adjusted in the feed direction.

11. A non-transitory computer-readable storage medium storing program code for causing an information processing apparatus to execute control of a liquid application apparatus that includes: a supply member including a cylindrical or columnar winding core around which a linear medium is wound; and a liquid application device configured to apply liquid to the linear medium unwound and fed from the supply member, the control comprising:

detecting or calculating a winding thickness of a remaining amount of the linear medium from an outer peripheral surface of the winding core;

adjusting a liquid application length of the liquid applied by the liquid application device to the linear medium in a feed direction of the linear medium in accordance with the winding thickness of the remaining amount of the linear medium; and applying, by the liquid application device, the liquid to the linear medium being fed at the liquid application length adjusted in the feed direction.

* * * * *